US005863691A

United States Patent [19]

Yamazaki et al.

[11] Patent Number: 5,863,691

[45] Date of Patent: Jan. 26, 1999

[54] TONER FOR DEVELOPING ELECTROSTATIC LATENT IMAGE DEVELOPER AND METHOD FOR PRODUCING IMAGE

[75] Inventors: Hiroshi Yamazaki; Shigenori Kouno; Michiaki Ishikawa, all of Hachioji; Mikio Kohyama, Hino, all of Japan

[73] Assignee: Konica Corporation, Japan

[21] Appl. No.: 881,218

[22] Filed: Jun. 24, 1997

[30] Foreign Application Priority Data

Jun. 28, 1996 [JP] Japan ..... 8-169371
Jul. 26, 1996 [JP] Japan ..... 8-197495

[51] Int. Cl.[6] ..... G03G 9/135

[52] U.S. Cl. ..... 430/110

[58] Field of Search ..... 430/110, 106, 430/109

[56] References Cited

U.S. PATENT DOCUMENTS 5,622,803 4/1997 Tavernier et al. ..... 430/110
5,635,326 6/1997 Kanbayashi et al. ..... 430/110

*Primary Examiner*—John Goodrow
*Attorney, Agent, or Firm*—Jordan B. Bierman; Bierman, Muserlian and Lucas

[57] ABSTRACT

Disclosed is a toner for developing an electrostatic latent image, comprising colored particles containing a colorant and a binder resin, and hydrophobic particles, wherein said colored particles have a BET specific surface area of not less than 5 $m^2/g$ and said hydrophobic particles satisfy the following relation:

$$|pH_A - pH_B| \leq 1.0$$

wherein said $pH_A$ is a pH value of said hydrophobic particles before heating and said $pH_B$ is a pH value of said hydrophobic particles after heating.

16 Claims, 3 Drawing Sheets

TONER FOR DEVELOPING ELECTROSTATIC LATENT IMAGE DEVELOPER AND METHOD FOR PRODUCING IMAGE

FIELD OF THE INVENTION

The present invention is related to a toner for developing an electrostatic latent image, a developer and a method for forming an image, which are employed in copiers, printers and the like.

BACKGROUND OF THE INVENTION

In recent years, the electrophotographic developing system has been employed in a variety of fields. For example, the system is used not only in the field of copiers but also in the fields of printers as output terminals of computers, color copiers, color printers, and the like. In accordance with the progress in those uses, requirements for image quality have been enhanced.

In order to improve the image quality, there have been provided too numerous proposals to mention wherein the image quality is improved by decreasing the diameter of a toner. However, in the conventional toner having the small diameter, when the only diameter of the toner itself is reduced, adhesive force due to a so-called van der Waals' force increases, On the contrary, it becomes difficult to apply desired charging properties to the toner, and the presence of the weakly charged toner and the excessively charged toner increases. As a result, there have been problems such that during the use of a prolonged period of time, fog is caused on the images and stain is caused in a developing unit or a carrier of two component development and the durability is deteriorated.

Furthermore, on the toner decreased in the diameter there has been a problem on charge rising. In order to solve the problem, it has been studied to improve the charge rising by the increase in the specific surface area of a colored toner itself. By doing so, certainly, the charge rising is improved. However, because the specific surface area is large, ambient conditions at the use depend on water adsorption of fine particles added as an external additive, the pH and further, variations in pH. As a result, there has been a problem such that a large variation in quality is caused by the changes in ambient conditions such as low temperature and low humidity, and high temperature and high humidity.

In addition, when utilizing efficiently the toner having the small diameter, the difference in density between the upper part and the lower part on a copy obtained has been found as one of problems.

This is an occurrence in that a carrier which is transported to a surface of a developing sleeve together with a toner is not removed from the surface of the developing sleeve and is transported again to a developing zone; due to this, the carrier transported again to the developing zone carries no desired amount of the toner and the density of an image on a copy of a document decrease gradually from of the upper side.

The decrease in the diameter of a toner enhances physical adhesive force between the toner and a carrier and as a result, the decrease in developability and deterioration in fluidity are caused. Due to these properties, the problem of the difference in density between the upper part and the lower part is caused remarkably.

In addition, the toner decreased in the diameter is highly adhesive to a photoreceptor and poor cleaning on the photoreceptor and defective images such as the formation of white spots are caused.

SUMMARY OF THE INVENTION

Accordingly, the first object of the present invention is to provide a toner for developing an electrostatic latent image, a developer and a method for forming an image, which in the toner employing colored particles having a large BET specific surface area, make it possible to improve the charge rising properties, cause no problem due to ambient variations and form consistent images.

The second object of the present invention is to provide a toner, developer and a method for forming an image, which make it possible to obtain consistent developability in spite of ambient variations.

The third object of the present invention is to provide a toner, a developer and a method for forming an image, which are not liable to form the difference in density between the upper part and the lower part.

The forth object of the present invention is to provide a toner, a developer and a method for forming an image, which result in high developability and cause no image defects such as a white spot, oblique line cut, etc. during the production of a number of copies for a long period of time.

The objects of the present invention have been accomplished by the following embodiments.

(1) A toner for developing an electrostatic latent image, which comprises colored particles having a BET specific surface area of 5 $m^2/g$ or more and a polar group on the surface, and hydrophobic particles having a water content of 1.0 weight percent or less.

(2) A toner for developing an electrostatic latent image, which comprises colored particles having a specific surface area of 5 $m^2/g$ or more and a polar group on the surface, and hydrophobic particles having a pH of 4 to 12.

(3) A toner for developing an electrostatic latent image, which comprises colored particles having a specific surface area of 5 $m^2/g$ or more and a polar group on the surface, and hydrophobic particles having the difference between $pH_A$ and $pH_B$ being not more than 1.0, wherein $pH_A$ is the pH of the hydrophobic particles before being left and $pH_B$ is the pH of the hydrophobic particles which is left at 50° C. and 50 percent relative humidity for 24 hours.

(4) A developer which comprises a toner for developing an electrostatic latent image, composed of colored particles having a specific surface area of 5 $m^2/g$ or more and a polar group on the surface, hydrophobic particles having a water content of 1.0 weight percent or less, and a carrier.

(5) A developer which comprises a toner for developing an electrostatic latent image, composed of colored particles having a specific surface area of 5 $m^2/g$ or more and a polar group on the surface and hydrophobic particles having a pH of 4 to 12, and a carrier.

(6) A developer which comprises a toner for developing an electrostatic latent image, composed of colored particles having a specific surface area of 5 $m^2/g$ or more and a polar group on the surface, and hydrophobic particles having the difference between $pH_A$ and $pH_B$ being not more than 1.0, wherein $pH_A$ is the pH of the hydrophobic particles before being left and $pH_B$ is the pH of the hydrophobic particles which is left at 50° C. and 50 percent relative humidity for 24 hours, and a carrier.

(7) In a method for forming an image wherein an electrostatic latent image formed on an imaging member is developed by a developer, the method for forming an image which utilizes the aforesaid developer which comprises a toner for developing an electrostatic latent image, composed of colored particles having a specific surface area of 5 $m^2/g$ or more and a polar group on the surface, and hydrophobic particles having a water content of 1.0 weight percent or less, and a carrier.

(8) In a method for forming an image wherein an electrostatic latent image formed on an imaging member is developed by a developer, the method for forming an image which utilizes the aforesaid developer which comprises a toner for developing an electrostatic latent image, composed of colored particles having a specific surface area of 5 $m^2/g$ or more and a polar group on the surface, and hydrophobic particles having a pH of 4 to 12, and a carrier.

(9) In a method for forming an image wherein an electrostatic latent image formed on an imaging member is developed by a developer, the method for forming an image which utilizes the aforesaid developer which comprises a toner for developing an electrostatic latent image, composed of colored particles having a specific surface area of 5 $m^2/g$ or more and a polar group on the surface, and hydrophobic particles having the difference between $pH_A$ and $pH_B$ being not more than 1.0, wherein $pH_A$ is the pH of the hydrophobic particles before being left and $pH_B$ is the pH of the hydrophobic particles which is left at 50° C. and 50 percent relative humidity for 24 hours, and a carrier.

(10) In a method forming an image comprising a process wherein an electrostatic latent image formed on an imaging member is developed by a developer to form a toner image, a process wherein an electrostatic latent image formed again on the imaging member having the aforesaid toner image is developed by the developer to form toner images, a process wherein the above-mentioned process is repeated to form a plurality of toner images on the aforesaid imaging member, and a process wherein the plurality of toner images formed on the aforesaid imaging member are simultaneously transferred to an image transfer material, the method for forming an image, which utilizes the aforesaid developer which comprises a toner for developing an electrostatic latent image, composed of colored particles having a specific surface area of 5 $m^2/g$ or more and a polar group on the surface and hydrophobic particles having a water content of 1.0 weight percent or less, and a carrier.

(11) In a method for forming an image comprising a process wherein an electrostatic latent image formed on an imaging member is developed by a developer to form a toner image, a process wherein an electrostatic latent image formed again on the imaging member having the aforesaid toner image is developed by the developer to form toner images, a process wherein the above-mentioned process is repeated to form a plurality of toner images on the aforesaid imaging member, and a process wherein the plurality of toner images formed on the aforesaid imaging member are simultaneously transferred to an image transfer material, the method for forming an image, which utilizes the aforesaid developer which comprises a toner for developing an electrostatic latent image, composed of colored particles having a specific surface area of 5 $m^2/g$ or more and a polar group on the surface and hydrophobic particles having a pH of 4 to 12, and a carrier.

(12) In a method forming an image comprising a process wherein an electrostatic latent image formed on an imaging member is developed by a developer to form a toner image, a process wherein an electrostatic latent image formed again on the imaging member having the aforesaid toner image is developed by the developer to form toner images, a process wherein the above-mentioned process is repeated to form a plurality of toner images on the aforesaid imaging member, and a process wherein the plurality of toner images formed on the aforesaid imaging member are simultaneously transferred to an image transfer material, the method for forming an image, which utilizes the aforesaid developer which comprises a toner for developing an electrostatic latent image, composed of colored particles having a specific surface area of 5 $m^2/g$ or more and a polar group on the surface and hydrophobic particles having the difference between $pH_A$ and $pH_B$ being not more than 1.0, wherein $pH_A$ is the pH of the hydrophobic particles before being left and $pH_B$ is the pH of the hydrophobic particles which is left at 50° C. and 50 percent relative humidity for 24 hours, and a carrier.

(13) A toner for developing an electrostatic latent image, which is composed of at least colored particles having a BET specific surface area of 5 $m^2/g$ or more and hydrophobic particles having a number average primary particle size of 5 to 2,000 nm.

(14) The toner described in (13) for developing an electrostatic latent image, wherein on the surface of the aforesaid colored particles, coverage by the aforesaid hydrophobic particles is from 5 to 80 percent.

(15) In a developer comprising a toner for developing an electrostatic latent image, composed of at least colored particles and hydrophobic particles, and a carrier, the developer wherein the specific surface area of the aforesaid colored particles is 5 $m^2/g$ or more and the number average primary particle size of the aforesaid hydrophobic particles is 5 to 2,000 nm.

(16) In a method for forming an image wherein an electrostatic latent image formed on an imaging member is developed by a developer to form an image, the method for forming an image wherein the aforesaid developer utilizes the toner for developing an electrostatic latent image, composed of at least colored particles and hydrophobic particles, and a carrier, and the BET specific surface area of the aforesaid colored particles is 5 $m^2/g$ or more and the number average primary particle size of the aforesaid hydrophobic particles is 5 to 2,000 nm.

(17) In a method for forming an image comprising a process wherein an electrostatic latent image formed on an imaging member is developed by a developer to form a toner image, a process wherein an electrostatic latent image formed again on the imaging member having the aforesaid toner image is developed by the developer to form toner images, a process wherein the above-mentioned process is repeated to form a plurality of toner images on the aforesaid imaging member, and a process wherein the plurality of toner images formed on the aforesaid imaging member are simultaneously transferred to an image transfer material, the method for forming an image wherein the aforesaid developer comprises the toner for developing an electrostatic latent image, composed of at least colored particles and hydrophobic particles, and a carrier, and the BET specific surface area of the aforesaid colored particles is 5 $m^2/g$ or more and the number average primary particle size of the hydrophobic particles is 5 to 2,000 nm.

(18) A toner for developing an electrostatic latent image which is composed of at least colored particles having a BET specific surface area of 5 $m^2/g$ or more and hydrophobic particles having a BET specific surface area of 30 to 60 $m^2/g$ and a number average primary particle size of 60 to 150 nm.

(19) The toner of item (18) for developing an electrostatic latent image wherein on the surface of the aforesaid colored particles, coverage of the aforesaid hydrophobic particles is 5 to 80 percent.

(20) The toner described in items (18) or (19) for developing an electrostatic latent image, which is composed of hydrophobic particles (A) having a BET specific surface area of 30 to 60 $m^2/g$ and a number average primary particle size of 60 to 150 nm and hydrophobic particles (B) having a BET specific surface area of 80 to 400 $m^2/g$ and a number average primary particle size of 5 to 100 nm.

(21) In a developer composed of a toner for developing an electrostatic latent image, comprising at least colored particles and hydrophobic particles, and a carrier, the developer wherein the BET specific surface area of the aforesaid colored particles is 5 $m^2/g$ or more and the BET specific surface area of the aforesaid hydrophobic particles is 30 to 60 $m^2/g$ and the number average primary particle diameter is 60 to 150 nm.

(22) In a method for forming an image wherein an electrostatic latent image formed on an imaging member is developed by a developer to form an image, the method for forming an image wherein the aforesaid developer utilizes a toner for developing an electrostatic latent image, composed of at least colored particles and hydrophobic particles and a carrier, and the BET specific surface area of the aforesaid colored particles is 5 $m^2/g$ or more and the BET specific surface area of the aforesaid hydrophobic particles is 30 to 60 $m^2/g$ and the number average primary particle size is from 60 to 150 nm.

(23) In a method for forming an image comprising a process wherein an electrostatic latent image formed on an imaging member is developed by a developer to form a toner image, a process wherein an electrostatic latent image formed again on the imaging member having the aforesaid toner image is developed by the developer to form toner images, a process wherein the above-mentioned process is repeated to form a plurality of toner images on the aforesaid imaging member, and a process wherein the plurality of toner images formed on the aforesaid imaging member are simultaneously transferred to an image transfer material, the method for forming an image, wherein the aforesaid developer utilizes a toner for developing an electrostatic latent image, composed at least colored particles and hydrophobic particles and a carrier, and the BET specific surface area of the aforesaid colored particles is 5 $m^2/g$ or more and the BET specific surface area of the aforesaid hydrophobic particles is 30 to 60 $m^2/g$ and the number average primary particle size is 60 to 150 nm.

(24) In a toner for developing an electrostatic latent image, composed of at least colored particles and hydrophobic particles, the toner for developing an electrostatic latent image, which is composed of the aforesaid colored particles having a BET specific surface area of 5 $m^2/g$ or more and the hydrophobic particles (A) having a number average particle size of 5 to 50 nm and the hydrophobic particles (B) having a number average particle size of 60 to 2,000 nm.

(25) The toner described in item (24) for developing an electrostatic latent image, wherein the coverage of the aforesaid hydrophobic particles is 5 to 80 percent.

(26) In a developer comprising a toner for developing an electrostatic latent image, composed of at least colored particles, hydrophobic particles and a carrier, the developer which is composed of the aforesaid colored particles having a BET specific surface area of 5 $m^2/g$ or more and the hydrophobic particles (A) having a number average particle size of 5 to 50 nm and the hydrophobic particles (B) having the number average particle size of 60 to 2,000 nm.

(27) In a method for forming an image, wherein an electrostatic latent image formed on a imaging member is developed by a developer and after transferring the formed toner image to a transfer material, the toner remaining on the imaging member is cleaned using a blade, the method for forming an image, which utilizes the aforesaid developer composed of a toner for developing an electrostatic latent image, composed of at least colored particles and hydrophobic particles, and a carrier, wherein the BET specific surface area of the aforesaid colored particles is 5 $m^2/g$ or more and the number average primary particle size of the hydrophobic particles (A) is 5 to 50 nm and that of the hydrophobic particles (B) is 60 to 2,000 nm.

(28) In a method for forming an image comprising a process wherein an electrostatic latent image formed on an imaging member is developed by a developer to form a toner image, a process wherein an electrostatic latent image formed again on the imaging member having the aforesaid toner image is developed by the developer to form toner images, a process wherein the above-mentioned process is repeated to form a plurality of toner images on the aforesaid imaging member, and a process wherein the plurality of toner images formed on the aforesaid imaging member are simultaneously transferred to an image transfer material, the method for forming an image wherein the aforesaid developer comprises a toner for developing an electrostatic latent image, composed of at least colored particles and hydrophobic particles and the aforesaid toner is composed of the colored particles having a BET specific surface area of 5 $m^2/g$ or more and the hydrophobic particles (A) having a number average primary particle size of 5 to 50 nm and the hydrophobic particles (B) having a number average primary particle size of 60 to 2,000 nm.

Figure 1:
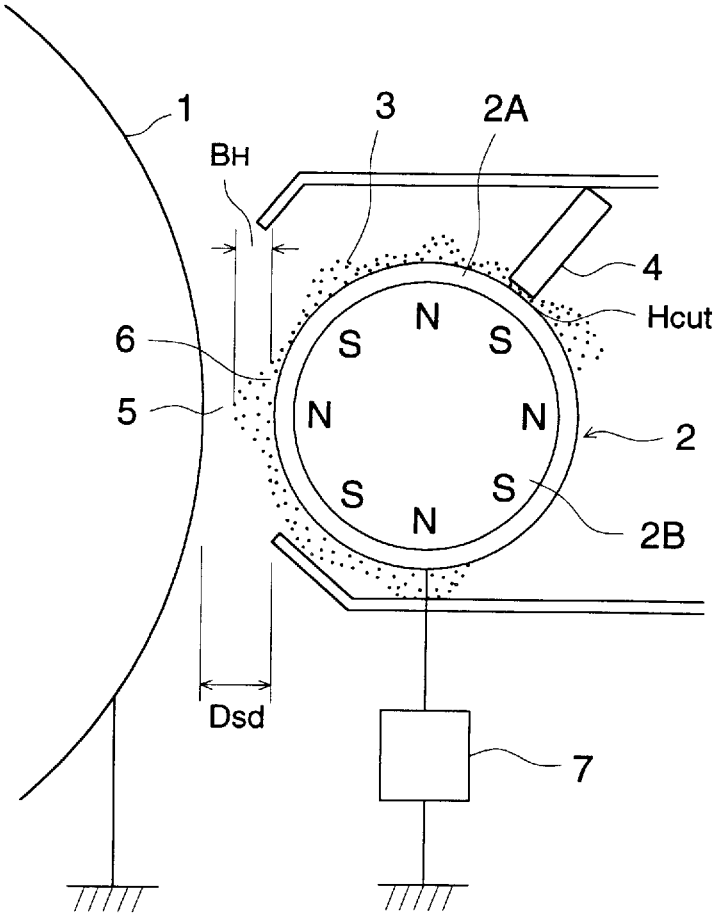
FIG. 1 is a schematic diagram illustrating one example of a non-contact developing system

1 Photoreceptor
2 Developer carrying member
2A Developing sleeve
2B Magnet
3 Two component developer
4 Developer layer regulating member
5 Developing zone
6 Developer layer
7 Electric power source for forming alternating electric field
11 Electrification member
12 Developing apparatus (developing unit)
13 Cleaning unit
14 Photoreceptor drum
15 Transfer drum
16 Transporting unit
17 Adhering electrode
18 Transfer electrode
19 Peeling electrode
20 Discharge electrode
21 Transporting member
31 Cleaning blade
33 Holder

DETAILED DESCRIPTION OF THE INVENTION

In the present invention, a large specific surface area of the colored particle itself and the presence of the polar group on the surface improves the charge rising properties. When the specific surface area is large, a problem is liable to be caused by ambient variations due to an external additive. The problems have been solved by employing the hydrophobic particles. Accordingly, the objects of the present invention have been accomplished.

In the present invention, with the use of the hydrophobic particles having a water content of 1.0 weight percent or less as an external additive, even a toner having a large specific surface area receives no effect from water and there is caused no problem such as decrease in a charge amount due to ambient variations. However, when the water content exceeds 1.0 percent, an electrification amount lowering problem is liable to be caused due to the increase in electrification leak affected by the water content.

In the present invention, the pH of the hydrophobic particles is preferable 4 to 12. It is preferred to adjust the pH within this range for stabilizing the electrification amount. When the pH is less than 4 or more than 12, the external additive itself is apt to contain a large amount of ionic component and due to the presence of the ionic component, the electrification leak is liable to be caused.

It is preferred that the pH of the hydrophobic particles of the present invention is kept constant when the particles are left in severe conditions such as high temperature and high humidity, etc. As one of causes of the variations in pH caused by leaving the hydrophobic particles alone, it is pointed out that volatile matters which are generated by a reaction of the surface of particles with a coupling agent which is employed for the surface treatment. The volatile matters are ammonia or acid components and the ambient variations can be prevented by reducing the concentration of the volatile matters.

The hydrophobic particles of which pH change satisfies the relationship of $|pH_A - pH_B| \leqq 1.0$, wherein $pH_A$ is the pH of the hydrophobic particles before being left and $pH_B$ is the pH of the hydrophobic particles which are left at 50° C. and 50 percent relative humidity for 24 hours is obtained by processing hydrophilic particles with a coupling agent for providing hydrophobicity for hydrophilic particles, followed by heating at temperatures of 30° to 100° C. and removing volatile matters.

Furthermore, the volatile matters may be removed using a pressure reduced process at temperatures of 30° to 100° C. In this case, as reduced pressure conditions, 1 to 100 mmHg is preferable.

In the above-mentioned method, when the temperature exceeds 100° C., problems are liable to be caused such that a unreacted coupling agent takes part in the reaction and furthermore, the surface of the hydrophobic particle is liable to be modified. On the other hand, when the temperature is less than 30° C., volatile matters are not liable to be removed and the prevention of the water adsorption becomes difficult.

As for the removal of volatile matters, may be employed a heating method in a dryer set at 30° to 100° C., or reduction in pressure accompanied with heating to accelerate the removal. A pH is measured immediately after heating and is measured after being left at 50° C./50 percent relative humidity for 24 hours. The heating is conducted until the difference in pH between both is 1 or less.

Further, in the present invention, the objects of the present invention are accomplished by employing a toner having a large surface area and hydrophobic particles having a specified particle size as an external additive.

With the use of the colored particles having a large surface area, namely, a BET specific surface area of 5 $m^2/g$ or more, an amount of electrification sites on the surface increases and moreover, with the use of the hydrophobic particles having a number average primary particle size of 5 to 2,000 nm, electrification properties can be stabilized for a long period of time.

When the BET specific surface area of the colored particles is less than 5 $m^2/g$, the electrification sites on the surface of the colored particles become insufficient and no charge rising cannot be secured. Furthermore, when the number average primary particle size of the hydrophobic particles is less than 5 nm or more than 2,000 nm, it is not liable to obtain the fluidity providing effect.

In addition, by specifying the amount of hydrophobic particles which exist on the surface of colored particles or to give a specific value to the coverage, electrification properties are readily maintained and durability are readily secured. When the coverage is less than 5 percent, the amount of the hydrophobic particles which exist on the surface of the colored particles is small and it becomes difficult to obtain sufficiently the fluidity providing effect due to the hydrophobic particles. Furthermore, when the coverage exceeds 80 percent, the hydrophobic particles cover all the surface of the colored particles and on account of the decrease in uncovered area of surface of colored particles, it is difficult to obtain the effect due to the colored particles having the high BET specific surface area.

Furthermore, with the use of the colored particles having a large BET specific surface area and, as an external additive, hydrophobic particles having a specified BET specific surface area, high stability can be secured.

In order to obtain the above-mentioned high stability, it is preferred that the hydrophobic particles have a BET specific surface area of 30 to 60 $m^2/g$ and a number average primary particle size of 60 to 150 nm. Though this reason has not been clarified, it is estimated that with the use of the hydrophobic particles having a large specific surface area compared to the particle size, a stable electrification property providing effect is maintained even at the time when burying occurs for the colored particles. Furthermore, it is estimated that with the use of particles having a large number average primary particle size, burying itself can be prevented and the stability is improved.

Furthermore, with the additional use of hydrophobic particles having a small particle in particle size, the fluidity of the toner itself can be improved and particularly under the ambient conditions of high temperature and high humidity, toner supplying properties can be improved. As a result, can be prevented the decrease in the fluidity of the toner caused at high temperature and high humidity and the generation of uneven images.

Further, by increasing the BET specific surface area of the toner having a small particle size, the electrification properties which the toner itself carries can be improved. In addition, by using a plurality of hydrophobic particles different in the particle diameter, the improvement in fluidity can be effectively given to the colored particles and further, the charge rising can be improved by the presence of the hydrophobic particles. Furthermore, by adding hydrophobic particles having a large particle size, the adhesion of the toner to a photoreceptor can be reduced and as a result, in a so-called blade cleaning method, can prevent problems caused by the decrease in the adhesion strength to the photoreceptor.

The embodiments of the present invention are explained more specifically.

(1) BET Specific Surface Area of Colored Particles

The BET specific surface area (because measurement results show that a toner has almost the same BET specific surface area, may be termed a BET specific surface area of the toner hereinafter) of the colored particles of the present invention is 5 $m^2/g$, or preferably 5 to 80 $m^2/g$ and more preferably 5 to 40 $m^2/g$.

The BET specific surface area is measured by a one-point method of a nitrogen adsorption method and as an available apparatus, Flow Sorb 2300 (manufactured by Shimadzu Seisakusho) is pointed out.

The colored particles of the present invention comprises preferably at least a resin and a colorant, and may comprise a releasing agent as a fixability improving agent, a charge control agent and the like as required.

Furthermore, the toner for developing an electrostatic latent image implies the toner composed of colored particles consisting of a so-called resin and a colorant to which an external additive composed of inorganic or organic particles, etc. are added. The toner (colored particles) of the present invention has a larger BET specific surface area than that which is generally prepared by a pulverization method, and comprises a resin having a polar group. The polar group includes preferably a group such as a carboxyl group, a sulfonic acid group and a phosphoric acid group.

The toner of the present invention can be prepared by for example, a method wherein a polymerizable monomer is subjected to an emulsion polymerization in a solution to which an emulsifying solution of a necessary additive is added and fine polymer particles are prepared, and then, after the addition of an organic solvent, a coagulating agent, etc., the resulting particles are coagulated. In order to exist a polar group on the surface, the polymerizable monomer having a polar group is employed and the orientation of the polar group is carried out by the reaction followed by coagulation.

The toner of the present invention is prepared by preferably using methods disclosed in Japanese Patent Publication Open to Public Inspection No. 5-265252, Japanese Patent Application Nos. 5-116672 and 6-223953, that is, a method wherein a plurality of fine particles composed of a binder resin, a colorant, etc. are coagulated, and particularly, these particles are dispersed into water with the use of an emulsifier, followed by being processed by a coagulating agent with the concentration higher than the critical coagulating concentration and an organic solvent being infinitely miscible with water. Furthermore, obtaing a polymer is heated and fused at a temperature not less than the glass transition temperature of the polymer and thus, the toner having the BET specific surface area of the present invention can be prepared.

In practice, monomers which are used to compose resins include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene or p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, etc.; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, etc.; olefines such as ethylene, propylene, isobutylene, etc.; halogenated vinyls such as vinyl chloride, vinylidene chloride, vinyl bromide, vinyl fluoride, vinylidene fluoride, etc.; vinyl esters such as vinyl propionate, vinyl acetate and vinyl benzoate; vinyl ethers such as vinyl methyl ether , vinyl ethyl ether , etc.; vinyl ketones such as vinyl methyl ketone, vinyl ethyl ketone, vinyl hexyl ketone, etc.; N-vinyl compounds such as N-vinylcarbazole, N-vinylindole, N-vinylpyrrolidone, etc.; vinyl compounds such as vinylnaphthalene, vinylpyridine, etc.; acrylic acids or methacrylic acid derivatives such as acrylonitrile, methacrylonitrile, acrylamide, etc. These vinyl monomers can be used individually or in combination. Further, as the monomer composing the resin, it is preferred to employ in combination a monomer having a polar group, which is preferably oriented on the surface of colored particles. Examples have as a composing group of the monomer a substituent group such as a carboxyl group, sulfonic acid group, phosphoric acid group, etc. and include specifically acrylic acid, methacrylic acid, maleic acid, itaconic acid, cinnamic acid, fumaric acid, maleic acid monoalkyl ester, itaconic acid monoalkyl ester, styrene sulfonic acid, allylsulfosuccinic acid, 2-acrylamide-2-methylpropane sulfonic acid, acid-phophoxyethylmethacrylate, 3-chloro-2-acid-phosoxypropylmethacrylate, etc.

Furthermore, resins having a bridge structure can be prepared by using multifunctional vinyl compounds such as divinyl benzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate, neopentylglycol diacrylate, etc.

Resins can be prepared from those monomers using a radical polymerization initiator. In this case, for a suspension polymerization method and a solution polymerization method, an oil-soluble polymerization initiator can be employed. As the oil-soluble polymerization initiator, can be employed azoisobutylonitrile, lauryl peroxide, benzoyl peroxide, etc. In addition, for an emulsion polymerization, a water-soluble radical polymerization initiator can be employed. As the water-soluble polymerization initiator, can be illustrated persulfate salts such as potassium persulfate, ammonium persulfate, etc., azobisaminodipropane acetic acid salt, azobiscyanovaleric acid and its salt, hydrogen peroxide, etc.

The glass transition point of resins employed is preferably 20° to 90° C. and the softening point is preferably 80° to 220° C. The glass transition point is measured by a differential thermal analysis method and the softening point is measured by a Koka Flow Tester. Moreover, the number average molecular weight (Mn) and weight average molecular weight (Mw) of these resins which are measured by a gel permeation chromatography are preferably from 1,000 to 100,000 and from 2,000 to 1,000,000, respectively. Further, as for the molecular weight distribution, Mw/Mn is preferably from 1.5 to 100 and particularly preferably from 1.8 to 70.

No available coagulating agents are particularly limited. However, agents selected from metal salts are suitably employed. Specifically, are illustrated as monovalent metals, salts of alkali metals such as sodium, potassium, lithium, etc. and as divalent metals, metal salts of alkali earth metals such as calcium, magnesium, etc. and salts of divalent metals such as manganese, copper, etc. and salts of trivalent metals such as iron, aluminum, etc. Illustrative salts can include sodium chloride, potassium chloride, lithium chloride, calcium chloride, zinc chloride, copper sulfate, magnesium sulfate, manganese sulfate, etc. These salts may be used in combination.

Those coagulating agents are preferably added at the concentration higher than the critical coagulation concentration. The critical coagulating concentration is an index to show the stability of an aqueous dispersion and shows the concentration at which coagulation is formed by the addition of the coagulating agent. The critical coagulating concentration varies largely according to an emulsified component and dispersing agent itself, as described, for example, in Seizo Okamura, et al. Kobunshi Kagaku (Polymer Chemistry) 17, 601 (1960), edited by Nihon Kobunshi Gakkai (Japan Polymer Society), etc. and it is useful to obtain the detailed critical coagulating concentration. In addition, as another method, a specified salt is added to a particle dispersion to be measured changing the concentration of the salt, and the ζ (zeta) potential of the resulting dispersion is measured and the critical coagulating concentration can be obtained as the concentration of the salt at which the potential varies.

In the present invention, an addition amount of the coagulating agent is suitably not less than the critical coagulating concentration, preferably 1.2 time or more and more preferably 1.5 time or more.

The solvent which is infinitely miscible with water indicates the solvent which can be dissolved infinitely to a polymer dispersion containing a colorant, that is, water. In the present invention, the solvent in which the prepared resin is not soluble is chosen. Specifically, can be illustrated alcohols such as methanol, ethanol, propanol, isopropanol, t-butanol, methoxyethanol, butoxyethanol, etc., nitoriles such as acetonitrile, etc., ethers such as dioxane, etc. Particularly, ethanol, propanol and isopropyl alcohol are preferable.

An addition amount of the solvent which is infinitely miscible with water is preferably from 1 to 300 volume percent for a dispersion containing a polymer to which a coagulating agent has been added.

Various methods are available for polymerization methods to prepare the resin which is used to prepare the colored particles of the present invention. However, as a particularly suitable method, the above-described emulsion polymerization method is employed.

As colorants employed in the colored particles of the present invention, carbon black, magnetic substances, dyes, pigments, etc. can be optionally employed. As carbon black, are employed channel black, furnace black, acetylene black, thermal black, lamp black, etc. As the magnetic substances, ferromagnetic metals such as iron, nickel, cobalt, etc., alloys comprising these metals, ferromagnetic metal compounds such as ferrite, magnetite, etc., alloys comprising non-ferromagnetic metal which shows ferromagnetism upon heating, for example, alloys termed Heusler's alloy such as manganese-copper-aluminum, manganese-copper-tin, chromium dioxide, etc.

As dyes, can be employed C.I. Solvent Red 1, the said 49, the said 52, the said 58, the said 63, the said 111, the said 122, C.I. Solvent Yellow 19, the said 44, the said 77, the said 79, the said 81, the said 82, the said 93, the said 98, the said 103. the said 104, the said 112, the said 162, C.I. Solvent Blue 25, the said 36, the said 60, the said 70, the said 93, the said 95, etc. Furthermore, a mixture of those dyes can be employed. As pigments can be employed C.I. Pigment Red 5, the said 48:1, the said 53:1, the said 57:1, the said 122, the said 139, the said 144, the said 149, the said 166, the said 177, the said 178, the said 222, C.I. Pigment Orange 31, the said 43, C.I. Pigment Yellow 14, the said 17, the said 93, the said 94, the said 138, C.I. Pigment Green 7, C.I. Pigment Blue 15:3, the said 60 and a mixture of these pigments can be employed. A primary number average particle size varies according to kinds. However, generally, the particle size is preferably 10 to 200 nm.

As an addition method of the colorant, can be employed a method wherein to a polymer itself prepared by an emulsion polymerization method, at the coagulation stage by the addition of a coagulating agent, the colorant is added and the polymer is dyed or another method wherein the colorant is added at the stage of polymeriable monomers followed by polymerization and preparing dyed particles. Further, when the colorant is added at the stage of preparing the polymer, it is preferred that when added, the surface is processed with a coupling agent, etc. so that the radical polymerization is not hindered.

Furthermore, as fixability improving agents, may be employed polypropylene (number average molecular weight=1,500 to 9,000) having a low molecular weight and polyethylene having a low molecular weight. Furthermore, as charge control agents, azo metal complexes and quaternary ammonium salts may be employed.

The colored particles of the present invention can be prepared by coagulating a plurality of the above-mentioned polymers. In this case, to a polymer particle dispersion under stirring, a metal salt as a coagulating agent is added at higher concentration than the critical coagulating concentration and further, a solvent (for example isopropyl alcohol) infinitely miscible with water is added and then, the resulting mixture is heated at the temperature higher than the glass transition point of the polymer.

The particle size of the colored particles of the present invention is optional. However, the particles having a small particle size are liable to show the advantages of the present invention. The volume average particle size is preferably from 2 to 10 μm and particularly preferably from 3 to 9 μm. The particle size can be adjusted by the concentration of a coagulating agent, an addition amount of an organic solvent, and furthermore, a composition of the polymer itself. The volume average particle size of the colored particles is measured by the Coulter Counter TA-11 or Coulter Multisizer.

The following cases are considered for use of the colored particles of the present invention; for example, the colored particles comprising a magnetic substance is employed as a single component toner; the colored particles are mixed with a so-called carrier and are used as a two component developer and the colored particles are individually used as a non-magnetic toner, and the like. The colored particles can be suitably applied to any of the above cases. However, in the present invention, it is preferred that the colored particles are mixed with the carrier and are used as the two component developer.

As a carrier employed in the two component developer, may be used any of a non-coated carrier which is composed only of particles of magnetic materials such as iron, ferrite, etc. or a resin coated carrier wherein the surface of the particle of magnetic materials is covered with resin, etc. An average particle size, specifically volume average particle size of the carrier is preferably from 30 to 150 μm. The resin for covering, styrene-acrylic resin is preferably employed.

In the following, the hydrophobic particles are explained.

In the present invention, the hydrophobicity is expressed in methanol wetability. The methanol wetability is used to evaluate the wetability for methanol. Distilled water of 50 ml is placed in a 250 ml beaker and 0.2 g of particles is weighed and added. Methanol is with stirring slowly added from a burette of which outlet is immersed in the solution until all the particles are wet. The hydrophobicity is calculated by the following formula.

Hydrophobicity=[a/(a+50)]×100 wherein a is methanol volume in ml necessary for making all the fine particles wet In the present invention, the hydrophobicity of the hydrophobic particles are preferably not less than 20 and more preferably from 30 to 80.

Structure of Hydrophobic Inorganic Particles

As hydrophobic inorganic particles of the present invention, can be employed the hydrophobic inorganic particles having a number average particle size of 5 to 100 nm. This particle size is measured by the observation under a transmission electron microscope.

As materials comprised in the hydrophobic inorganic particles, are employed various kinds of inorganic oxides, nitrides, borides and the like. Examples include silica, alumina, titania, zirconia, barium titanate, aluminum titanate, strontium titanate, magnesium titanate, cerium oxide, zinc oxide, chromium oxide, antimony oxide, tungsten oxide, tin oxide, tellurium oxide, manganese oxide, boron oxide, silicon carbide, boron carbide, titanium carbide, silicon nitride, titanium nitride, boron nitride, etc.

As particularly preferred hydrophobic inorganic particles, silica, alumina, titania, zirconia can be illustrated. Though this reason is not clear, it is noted that these particles are effective to increase the fluidity of a toner and furthermore, hardness of the particles is high.

An addition amount of the hydrophobic inorganic particles to a toner is 0.1 to 5 weight percent and preferably 0.2 to 2.0 weight percent. When the addition amount of the hydrophobic inorganic particles is less than 0.1 weight percent, the fluidity of the toner is apt to be lowered. Further, when the addition amount is larger than 5 weight percent, so that charging electrodes are liable to be stained due to released inorganic particles.

In the present invention, water content can be adjusted, when practiced, using drying under reduced pressure and drying by heating. No method for measuring the water content will be specified. However, the measurement method with the use of Karl Fischer's method is suitably employed. As a practical measurement method, the water content is measured by the Hiranuma Micro Water Meter (AQS-712, manufactured by Hiranuma Sangyo Co., Ltd.) under the following conditions.

Temperature for heating a sample: 110° C.

Period for heating a sample: 1 minute

Flow rate of nitrogen gas : 150 ml/minute

Furthermore, pH can be adjusted by the selection of various materials for treating the surface. For the adjustment to an alkali side, the pH can be adjusted using surface treating agents having a substituent group with a structure of amine, amino group and ammonium salt. For the adjustment to an acid side, the pH can be readily adjusted using a processing agent having an acid component as a free group and a compound having a structure in which an acid is released upon coupling reaction.

The measurement method of pH is such that 4 g of a sample is put in 100 cc of water and a resulting mixture is stirred for five minutes at room temperature (20° C.) and then, the pH is measured by a pH meter. In this case, in order to prevent the volatilization of volatile component, agitation is preferably performed in a tightly closed vessel.

Hydrophobic treatment is preferably carried out by various titanium coupling agents and silane coupling agents. In addition, the hydrophobic treatment is preferably carried out by higher fatty acid metal salts such as aluminum stearate, zinc stearate, calcium stearate, etc. The titanium coupling agents include tetrabutyl titanate, tetraoctyl titanate, isopropyltriisostearoyl titanate, isopropyltridecylbenzenesulfonyl titanate, bis(dioctylpyrophosfate)oxyacetate titanate, and the like. In addition, the silane coupling agents include γ-(2-aminoethyl)aminopropyltrimethoxysilane, γ-(2-aminoethyl) aminopropylmethyldimethoxysilane, γ-methacryroxypropyltrimethoxysilane, N-β-(N-vinylbenzylaminoethyl)-γ-aminopropyltrimethoxysilane hydrochloride salt, hexamethyldisilazane, methyltrimethoxysilane, butyltromethoxysilane, isobutylmethoxysilane, hexyltrimethoxysilane, octyltrimetoxysilane, decyltrimethoxysilane, dodecyltrimethoxysilane, phenyltrimethoxysilane, o-methylphenyltrimethoxysiline, p-methylphenyltrimethoxysilane and the like.

Particularly, as examples of coupling agents which generate a volatile component, there are hexamethyldisilazane, dichlorodimethylsilane, 3-aminopropyltriethoxysilane, alkyltrialkoxysilane, etc. The variation in pH is remarkable for hexamethyldisilazane and dichlorodimethylsilane in which hydrocholeric acid or ammonia is released at the hydrophobic treatment. Fatty acids and the metal salts include long chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linoleic acid, arachidonic acid, etc. and the metal salts such as salts with zinc, iron, magnesium, aluminum, calcium, sodium, lithium , etc.

The addition amount of the above-mentioned compounds to the inorganic particles for covering is preferably from 1 to 10 percent by weight and more preferably from 3 to 7 percent by weight. Furthermore, the above-mentioned compounds may be employed in combination.

Structure of Hydrophobic Organic Particles

When hydrophobic organic particles are employed, styrene resins, olefin resins and acrylic acid ester resins are preferably employed. The reason is that resins are readily prepared by an emulsion polymerization and a suspension polymerization.

As materials for constituting the hydrophobic organic particles, there are specifically illustrated styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimetylstyrene, p-t-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, etc.; acrylic acid ester derivatives, etc. such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimethylaminoethyl acrylate, diethylaminoethyl acrylate, etc. These monomers may be employed individually or in combination.

In addition, other materials for constituting the hydrophobic organic particles include olefines such as ethylene, propylene, isobutylene, etc.; vinyl halides such as vinyl chloride, vinylidene chloride, vinyl bromide, vinyl fluoride, vinylidene fluoride, etc.; vinyl esters such as vinyl propionate, vinyl acetate and vinyl benzoate; vinyl ethers such as vinyl methyl ether, vinyl ethyl ether, etc.; vinyl ketones such as vinyl methyl ketone, vinyl ethyl ketone, vinyl hexyl ketone, etc.; N-vinyl compounds such as N-vinyl carbazole, N-vinyl indole, N-vinyl pyrrolidone, etc.; acrylic acid or methacrylic acid derivatives such as acrylonitrile, methacrylonitrile, acrylamide, N-butyl acrylamide, N,N-dibutylacrylamide methacrylamide, N-butyl methacrylamide, N-octadecyl acrylamide, etc. These vinyl monomers can be employed individually or in combination.

Furthermore, it is preferred that the developer comprising the hydrophobic organic particles is stable for the use of long period of time. On account of the above, it is preferred that the organic particle itself is cross-linked by various cross-linking agents and the particle having high hardness is used. As the cross-linking agents, there are illustrated divinyl benzene, ethyleneglycol diacrylate, diethyleneglycol diacrylate, triethyleneglycol diacrylate, ethyleneglycol dimethacrylate, diethyleneglycol dimethacrylate, triethyleneglycol dimethacrylate, etc. An addition amount of the cross-linking agents is adjusted according to a desired degree of cross-linking and for vinyl monomers, the amount of 0.1 to 5 percent by weight is preferably employed. When the addition amount of the cross linking agent exceeds 5 percent by weight, the hardness increases. However, on the contrary, the durability is liable to decrease due to the increase in brittleness. Further, when the addition amount is less than 0.1 percent by weight, it is apt to be difficult to obtain sufficient hardness.

The hydrophobic organic particles can be prepared by an emulsion polymerization method and a suspension polymerization method. In the emulsion polymerization, the above-mentioned monomer is added to aqueous solution containing a surface active agent followed by emulsification and polymerization. No surface active agents are specified and those which are termed surface active agents, are all available such as dodecylbenzene sulfonate, surface active agents having addenda such as polyvinyl alcohol, ethylene oxide, etc. Furthermore, non-emulsification polymerization method is preferably used wherein the monomer itself has a surface active function.

Polymerization initiators which enable the synthesis of the hydrophobic organic particles include peroxides such as benzoyl peroxide and lauryl peroxide, etc. and azo type polymerization initiators such as azobisisobutylonitrile, azobisisovaleronitrile, etc. The addition amount is preferably from 0.1 to 2 weight percent of the monomer. When the addition amount is 0.1 weight percent or less, polymerization reaction does not sufficiently proceeds and a problem of remaining monomers is caused. Further, when the addition amount is exceeds 2 weight percent, decomposed compounds of the polymerization initiator are liable to remain and are subjected to electrification properties. In addition, because the polymerization reaction tends to accelerate, the molecular weight is liable to become small.

As hydrophobic organic particles, can be employed particles of polymers such as polyurethane, polyurea, ployester, phenol-formaldehyde condensation products, melamine-formaldehyde condensation products, etc.

The number average primary particle size of the hydrophobic organic particles is preferably from 10 to 2,000 nm and more preferably from 100 to 1,500 nm. When the particle size is less than 10 nm, improving effect for the transferability is liable to be degraded. When the diameter is more than 2,000 nm, the hydrophobic organic particles are not liable to adhere onto the toner and released hydrophobic organic particles adheres onto a photoreceptor and fog and image stain are liable to be caused, and improving effect for the transferability is liable to be degraded.

Furthermore, the coverage of the hydrophobic particles on the surface of the colored particles is preferably 5 to 80 percent and particularly 30 to 65 percent. When the coverage for the surface of the colored particles is less than 5 percent, the advantage obtained by the addition of hydrophobic particles is not liable to be obtained. When the coverage is larger than 80 percent, the hydrophobic particles cover excessively the surface of the colored particles and it is found that the adhesive properties of the colored particles to a transfer material tends to be lowered.

The coverage represents the ratio of how much the surface of a toner is covered by the presence of the hydrophobic particles (external additive).

In the following, a practical method for calculating the coverage is explained.

At first, the number n of particles is obtained which can be put on one toner particle.

The number is obtained by dividing the surface area of one colored particle by the covered area of one hydrophobic particle.

The surface area of one colored particle is obtained from the BET specific surface area and the volume average particle size of the colored particles. (Value of one half of total surface area of one particle obtained from number average particle size of the colored particles)

$$n = Bt \times (4/3)\pi Rt^3 \times \rho t / ((1/2) 4\pi Ra^2)$$

Secondly, from this value, is calculated an addition amount (limiting addition amount) of the hydrophobic particle, in which the hydrophobic particles cover the whole surface of the colored particle.

Limiting addition amount (weight percent) =

$$((4/3)\pi Ra^3 \times n \times \rho a)/((4/3)\pi Rt^3 \times \rho t + (4/3)\pi Ra^3 \times n \times \rho a) \times 100$$

The coverage is represented by the percentage of an practical addition amount to a limiting addition amount.

Coverage (percent)=Practical addition amount (weight percent)/limiting addition amount (weight percent)×100

It is noted that in the foregoing, each symbol is defined as follows.

Bt: BET value of colored particles ($m^2/g$)

Rt: Radius of colored particle obtained from a volume average particle size of colored particle ($\mu$m)

Ra: Radius of hydrophobic particle obtained by a number average particle size of hydrophobic particles ($\mu$m)

$\rho t$: density of colored particle ($g/cm^3$)

$\rho a$: density of hydrophobic particle ($g/cm^3$)

$\pi$: ratio of the circumference of a circle to its diameter

Method for Forming Image

There is no restriction for a developing method to which the toner of the present invention is applied. The toner is suitably applied to a contact developing method or non-contact developing method. In the development of the contact developing method, the layer thickness of a developer comprising the toner of the present invention is from 0.1 to 8 mm in the developing zone and more preferably from 0.4 to 5 mm. Furthermore, in this case, the gap between a photoreceptor and a developer carrying member is 0.15 to 7 mm and preferably 0.2 to 4 mm.

In addition, in the non-contact developing method, a developer layer formed on a developer carrying member has no contact with a photoreceptor. For composing this developing method, it is preferred that the developer layer is formed in a thin layer. In this method, the developer layer having a thickness of 20 to 500 μm is formed in the developing zone. As a result, the gap between the photoreceptor and the developer carrying member is larger than the thickness of the above-mentioned developer layer.

Especially, the toner of the present invention shows high charge rising properties and is useful for the non-contact developing method. Namely, because in the non-contact development method, variation in a development electric field is large, the variation in minute charge affects highly the development itself. On account of the foregoing, the big variation of developing performances such as image quality and density is caused due to variation in a charge amount of the toner. However, since the toner of the present invention shows high charge rising properties, the variation in electrification amount is small and can secure the electrification amount having no big variation. As a result, even with the use of the non-contact development method, consistent images are prepared for a long period of time.

In the non-contact developing method, the formation of a thin layer is performed by a magnetic blade utilizing magnetic force and a method wherein a developing layer controlling stick is pushed onto the surface of the developer carrying member. Furthermore, there is another method wherein the developing layer is regulated by contacting a urethane blade, phosphor bronze plate, etc. on the surface of the developer carrying member. Suitable pushing pressure of the pushing pressure adjusting member is from 1 to 15 gf/mm. When the pushing pressure is small, transportation tends to be unstable due to the shortage of the control force. On the other hand, when the pushing pressure is large, the impact to the developer becomes large and the durability of the developer tends to be lowered. The more preferred range is from 3 to 10 gf/mm.

Furthermore, in the non-contact developing method, when development bias is provided when developing, a method only to provide direct current component may be used. In addition, a method to apply A.C. bias may also be used.

As dimensions of the developer carrying member, 10 to 40 mm in the diameter is preferable. When the diameter is smaller than the aforesaid range, mixing the developer is liable to become insufficient and it is apt to become difficult to secure enough mixing so as to provide enough charges to the toner. When the diameter is not less than the aforesaid range, the centrifugal force becomes large for the developer and a problem such as toner scatter is liable to be caused.

In the following, referring to FIG. 1, one example of the non-contact developing method is explained.

FIG. 1 is a schematic diagram of a developing portion of a non-contact developing method which is suitably applied to the imaging method of the present invention. The numeral 1 is a photoreceptor; 2 is a developer carrying member; 3 is a two component developer comprising the toner of the present invention; 4 is a developer layer regulating member; 5 is a developing zone; 6 is a developer layer and 7 is an electric power source for the formation of an alternating electric field.

The two component developer comprising the toner of the present invention is held by magnetic force on the developer carrying member 2 having a magnet 2B in the interior and is transported to the developing zone 5 by the movement of a developer sleeve 2A. At this transportation, the thickness of the developer layer 6 is adjusted in the developing zone 5 by the developer layer regulating member 4 so that it has no contact with the photoreceptor 1.

The minimum gap distance (Dsd) in the developing zone 5 is larger, for example, from about 100 to about 1,000 μm than the thickness (preferably from 20 to 500 μm) of the developer layer 6. The electric power source 7 for forming the alternating electric field supplies preferably alternating current of frequency of 1 to 10 kHz and voltage in absolute value of 1 to 3 kvp-p. The electric power source 7 may have a composition in which direct current is wired in series to alternating current. Voltage of the direct current is preferably from 300 to 800 V.

When the toner of the present invention is applied to a color image forming system, there is a system (shown in FIG. 2 as termed a serial transferring system) a one-colored image is formed on a photoreceptor and the resulting image is serially transferred to a transfer material (generally, plain paper), or there is another system (shown in FIG. 3 as termed a simultaneous transfer system) wherein a plurality of one-colored images are formed on a photoreceptor and the resulting images are simultaneously transferred to a transfer material.

Figure 2:
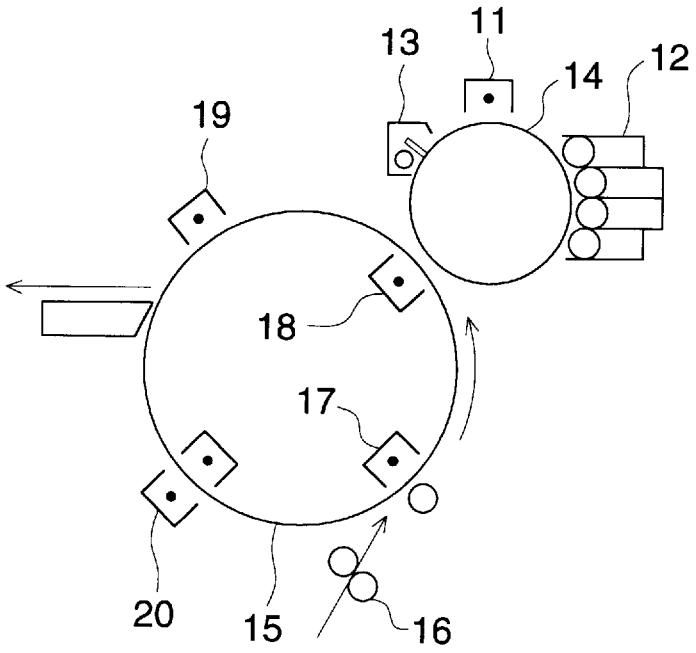
FIG. 2 is a schematic diagram showing one example of a serial transferring system
Figure 3:
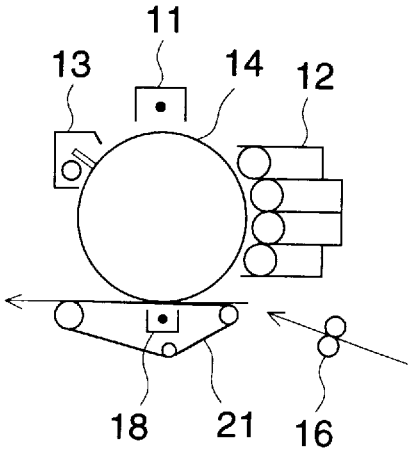
FIG. 3 is a schematic diagram showing a simultaneous transferring system

The imaging systems in FIGS. 2 and 3 are explained in detail in the following.

As a developer carrying member employed in the present invention, as shown in FIG. 1, a developing device in which the magnet 2B is arranged in the carrying member. As the developing sleeve 2A, aluminum, surface-oxidized aluminum or stainless steal is employed.

In the following, one example of the serial transfer system shown in FIG. 2 is explained.

The numeral 11 is a electrification member which works as a charging electrode; 12 is a developing apparatus composed of developing devices which supply each of yellow, magenta, cyan and black toners, which is divided into four vessels. The basic construction of these developing units is the same as the schematic diagram of the developing portion shown in FIG. 1. The numeral 14 is a photoreceptor drum; 13 is a cleaning unit; 15 is a transfer drum which holds temporarily a one-colored toner image on the photoreceptor drum and holds another one-colored image and finally holds a desired multicolored image; 16 is a transporting unit which transports a transfer material to which the toner image on the transfer drum is transferred; 17 is an adhering electrode which is arranged in the interior of the transfer drum 15 and adheres electrostatically the transfer material to the aforesaid drum by corona discharge from the inside; 18 is a transfer electrode which transfers successively the toner image formed on the photoreceptor drum 14 to the transfer drum; 19 is a peeling electrode which peels the transfer material adhered electrostatically onto the transfer drum 15; 20 is a discharge electrode which eliminates remaining charges on the transfer drum after transferring and peeling.

On the photoreceptor drum 14, is uniformly formed charges by the electrification member 11, Then, an image-wise exposure is made (means is not shown.), an electrostatic latent image is formed . The electrostatic latent image is developed by the developing device having one color of the toner (for example, black toner) of the developing apparatus 12 and one-colored toner image is formed on the photoreceptor drum. On the other hand, the transfer material transported onto the transfer drum 15 by the transporting unit 16 is electrostatically adhered onto the transfer drum by the adhering electrode 17 and is transported to a transfer zone.

The aforesaid toner image formed on the photoreceptor drum 14 in the transfer zone is transferred to the transfer material transported. The toner remains on the photoreceptor drum 14 after the aforesaid toner image is transferred. The remaining toner is cleaned by a cleaning unit 13 and is employed in the repeated process.

When forming a multicolor image, according to the similar process, other colored toner image is formed by development and is transferred successively to the transfer drum 15. Finally, a transfer material on which a desired toner image is transferred is peeled by the peeling electrode 19 and is transported to a fixing zone and a fixed multicolor image is finally obtained. On the other hand, the remaining charge on the transfer drum 15 is eliminated by the discharge electrode 20 and the transfer drum is employed in the repeated process.

Next, referring to FIG. 3, the simultaneous transferring system is explained.

Explanation on each part of the apparatus is abbreviated, because it is the same as that in the example of FIG. 2. However, 21 is a transporting member which transfers a toner image while transporting a transfer material transported. On a photoreceptor drum 14, charges are uniformly formed by a charging electrode. Then, an electrostatic latent image is formed by a latent image forming means. The electrostatic latent image is developed by a developing device having one-colored toner (for example, black toner) of a developing apparatus 12 and a one-colored toner image is formed on a photoreceptor drum. In the example shown in the figure, the toner image is not transferred and on the photoreceptor drum having the aforesaid toner image, charges are again formed by the electrification member 11; furthermore, an electrostatic latent image is formed; and is developed by a developing device having a different colored toner from the foregoing; another colored toner image is formed by superimposing on the previously formed toner image. During the above-mentioned process, a cleaning unit 13, a transfer electrode 18, and a transporting member 21 are not operated and are withdrawn so that no toner image on the photoreceptor drum 14 is damaged.

Upon finishing the formation of a desired image, the multicolored toner images are formed. Then, the toner image on the photoreceptor drum, while being transported to a transporting member 21, is transferred by the transfer electrode to the transfer material transported by a transporting unit 16. The transfer material holding the transferred toner image thereon is transported to a fixing zone, is fixed, and a final multicolored toner image is formed on the transfer material. Because the toner remains on the photoreceptor drum, it is cleaned by the cleaning unit 13 and is used in the repeated process.

In the above-mentioned various methods, a toner image formed on the photoreceptor drum is transferred to a transfer material such as a sheet of paper. The transfer process is not limited and various processes such as a so-called corona transfer process or a roller transfer process can be utilized.

The toner of the present invention has a high transfer efficiency and remains a little on a photoreceptor. Therefore, when for example, a blade cleaning method is used, a contact enforcing pressure of the blade onto the photoreceptor and the like can be reduced and an advantage is effected such as the extension of the life of the photoreceptor and the like.

After the toner image is transferred to a transfer material, the toner remaining on a photoreceptor is cleaned by a cleaning process and the photoreceptor is repeatedly employed for the next process.

In the present invention, the cleaning method is not particularly limited. Known cleaning methods such as a blade cleaning method, a magnetic brush cleaning method, a fur brush cleaning method, etc. can be optionally employed. According to the above-mentioned reason, an appropriate cleaning method is of the blade cleaning using a so-called cleaning blade.

Figure 4:
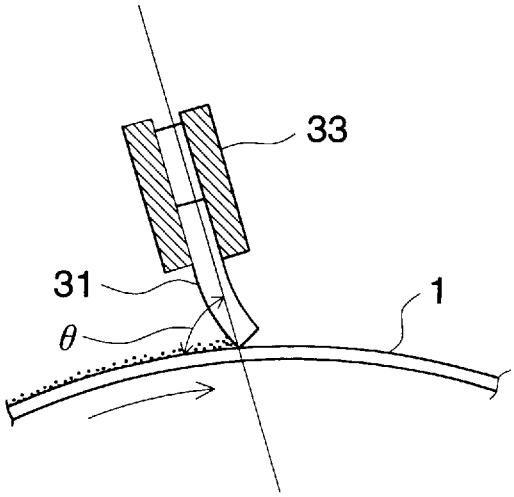
FIG. 4 is a schematic diagram showing one example of a blade cleaning method
Figure 5:
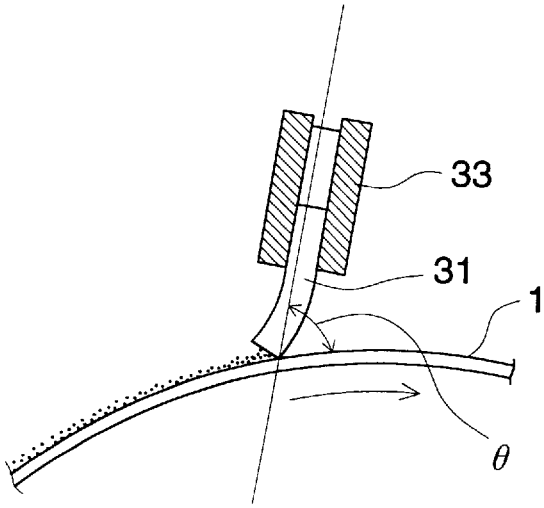
FIG. 5 is a schematic diagram showing another example of a blade cleaning method (Explanation of Symbols)

Either structure described in FIG. 4 or FIG. 5 can be employed. FIGS. 4 and 5 illustrate structures wherein a holder 33 holds a cleaning blade 31 and 1 is a photoreceptor, and θ is an angle formed by the holder 33 and the photoreceptor 1. In FIGS. 4 and 5, both θs are 10° to 90° and preferably 15° to 75°.

As a material constituting the cleaning blade 31, can be used an elastic material such as silicone rubber, urethane rubber, etc. In this case, the rubber hardness is preferably 30° to 90°. The thickness of the cleaning blade is preferably 1.5 to 5 mm and the external length of the holder portion is preferably 5 to 20 mm. The enforced contacting pressure against the photoreceptor is preferably 5 to 50 gf/mm.

EXAMPLE

Example 1

(Inorganic Hydrophobic Particle Preparation Example))

Preparation Example 1

Hydrophobic silica was obtained by treating hydrophilic silica having a primary particle size of 12 nm with dimethylchlorosilane. The pH of the resulting compound was 3.1 immediately after the preparation. It was stored at 50° C. for 48 hours in a dryer. The pH ($pH_A$) after heating was 5.1. It was stored in a dryer conditioned at 50° C. and 50 percent relative humidity for 24 hours. The pH ($pH_B$) after heating was 5.4. Furthermore, the water content was 0.3 weight percent. The resulting material was termed "Silica 1". The silica which was not stored in the dryer was termed "Comparative Silica 1". The water content of "Comparative Silica 1" was 1.2 weight percent and the $pH_B$ of "Comparative Silica 1" was 5.3 ($pH_A$=3.1) and the difference was 2.2.

Preparation Example 2

Hydrophobic silica was obtained by treating hydrophilic silica having a primary particle size of 7 nm with hexamethyldisilazane. The pH of the resulting compound was 7.6 soon after the preparation. It was stored in a dryer at 60° C. for 100 hours. The pH ($pH_A$) after drying was 6.0. Then, it was stored in a dryer conditioned at 50° C. and 50 percent relative humidity for 24 hours. The pH ($pH_B$) after heating was 5.9. The water content was 0.2 weight percent. It was termed "Hydrophobic Silica 2".

Preparation Example 3

In Preparation Example 2, instead of storing in the dryer kept at 60° C., drying was performed at a temperature of 60° C. under a reduced pressure of 10 mmHg for 24 hours. The pH after drying was 5.8. The water content was 0.2 weight percent. It was termed "Hydrophobic Silica 3".

Preparation Example 4

Hydrophobic silica was obtained by treating hydrophilic silica having a primary particle size of 12 nm with γ-(2-aminoethyl)aminopropyltrimethoxysilane. The pH was 13.8 immediately after the preparation. The resulting compound was stored in a dryer at 50° C. for 48 hours. The pH ($pH_A$) after heating was 12.1. Then, it was stored in a dryer conditioned at 50° C. and 50 percent relative humidity for 24 hours. The pH ($pH_B$) after heating was 11.9. Moreover, the water content was 0.3 weight percent. It was termed "Hydrophobic Silica 4". Silica which was not stored in the dryer was termed "Comparative Silica 2". The water content of "Comparative Silica 2" was 1.3 weight percent. In addition, the $pH_B$ of Comparative Silica 2 was 12.6. The difference from $pH_A$ (=13.8) was 1.2.

Preparation Example 5

Hydrophobic silica was obtained by treating hydrophilic silica having a primary particle size of 52 nm with trimetoxyoctylsilane. The pH was 8.3 immediately after the preparation. The resulting compound was stored in a dryer at 60° C. for 100 hours. The pH ($pH_A$) after heating was 6.8. Then, it was stored in a dryer conditioned at 50° C. and 50 percent relative humidity for 24 hours. The pH ($pH_B$) after heating was 6.7. The water content was 0.1 weight percent. It was termed "Hydrophobic Silica 5".

Colored Particle Preparation Example 1

To a solution prepared by dissolving 4.92 g of sodium dodecylsulfate into 120 ml of pure water, was added 10.67 g of the compound obtained by treating the carbon black (Morgal L manufactured by Cabot Corp.) with the aluminum coupling agent (Plainact A1-M manufactured by Ajinomoto Co., Ltd.) followed by stirring under ultrasonic wave and an aqueous carbon black dispersion was prepared. In addition, low molecular weight polypropylene (number average molecular weight =3,200) was dispersed into water using a surface active agent under heating and an emulsified dispersion having a solid portion concentration of 20 weight percent was prepared. With the aforesaid carbon black dispersion was mixed 43 g of the low molecular polypropylene emulsified dispersion, further, 96.1 g of styrene monomer, 25.4 g of n-butylmethacrylate monomer, 6.1 g of methacrylic acid monomer, 3.3 g of t-dodecylmercaptan and 850 ml of deaerated pure water and the temperature of the resulting mixture was raised to 70° C. with stirring under nitrogen gas flow. Then, 200 ml of pure water to which 4.1 g of potassium persulfate had been dissolved was added and the resulting mixture underwent reaction at 70° C. for 6 hours. The resulting colored particle dispersion comprising the carbon black was termed "Dispersion 1". The primary particle size of the dispersion was measured (Light Scattering Electrophoretic Particle Diameter Measuring Apparatus ELS-800 manufactured by Ohtsuka Denshi Kogyo Co., Ltd.) and the molecular weight distribution was also measured (GPC was used; styrene-based converted molecular weight). Results are shown in Table 1 in the following. To 600 ml of this "Dispersion 1", were added 160 ml of 2.7 mole percent of aqueous potassium chloride solution, furthermore, 94 ml of isopropyl alcohol, 40 ml of pure water to which 5.4 g of polyoxyethyleneoctylphenyl ether (average polymerization degree of ethylene oxide is 10) is dissolved. Then, the temperature was raised up to 85° C. at a rate of 5° C./minute and the reaction was conducted for 6 hours. After the completion of the reaction, the resulting solution was filtrated, washed and dried and the colored particles of the present invention were obtained. The resulting particles were termed "Colored Particle 1".

Colored Particle Preparation Example 2

The colored particles of the present invention were prepared in the same manner as in Colored Particle Preparation Example 1 except that C.I. Pigment Blue 15:3 was employed instead of the surface treated carbon black. Further, the resulting dispersion was termed "Dispersion 2" and the resulting colored particles were termed "Colored Particle 2".

Colored Particle Preparation Example 3

The colored particles of the present invention were prepared in the same manner as in Colored Particle Preparation Example 1 except that C.I. Pigment Red 122 was employed instead of the surface treated carbon black. Further, the resulting dispersion was termed "Dispersion 3" and the resulting colored particles were termed "Colored Particle 3".

Colored Particle Preparation Example 4

The colored particles of the present invention were prepared in the same manner as in Colored Particle Preparation Example 1 except that C.I. Pigment Yellow 17 was employed instead of the surface treated carbon black. Further, the resulting dispersion was termed "Dispersion 4" and the resulting colored particles were termed "Colored Particle 4".

Colored Particle Preparation Example 5

The colored particles of the present invention were prepared in the same manner as in Colored Particle Preparation Example 1 except that "Dispersion 1" was employed and the volume of isopropyl alcohol added was 125 ml. The resulting particles were termed "Colored Particle 5".

Colored Particle Preparation Example 6

The colored particles of the present invention were prepared in the same manner as in Colored Particle Preparation Example 2 except that "Dispersion 2" was employed and the volume of 2.7 mole percent of aqueous potassium chloride solution added was 250 ml. The resulting particles were termed "Colored Particle 6".

Colored Particle Preparation Example 7

The colored particles of the present invention were prepared in the same manner as in Colored Particle Preparation Example 3 except that "Dispersion 3" was employed and the volume of isopropyl alcohol added was 72 ml and the volume of 2.7 mole percent of aqueous potassium chloride solution added was 200 ml. The resulting particles were termed "Colored Particle 7".

Colored Particle Preparation Example 8

The colored particles of the present invention were prepared in the same manner as in Colored Particle Preparation Example 4 except that "Dispersion 4" was employed and the volume of isopropyl alcohol added was 72 ml and the volume of 2.7 mole percent of aqueous potassium chloride solution added was 200 ml. The resulting particles were termed "Colored Particle 8".

Comparative Colored Particle Preparation Example 1

To 100 parts of styrene-n-butylacrylate copolymer (copolymerization ratio =85:15, weight average molecular weight=63,000) were added 10 parts of carbon black, 5 parts of low molecular weight polypropylene (number average molecular weight=3,200), and the resulting mixture was kneaded followed by pulverization and classification and the comparative colored particles were obtained. The resulting particles were termed "Comparative Colored Particle 1".

Comparative Colored Particle Preparation Example 2

The comparative colored particles were obtained in the same manner as in Comparative Colored Particle Preparation 1 except that C.I. Pigment Blue 15:3 was employed instead of the carbon black. The resulting particles were termed "Comparative Colored Particle 2".

Comparative Colored Particle Preparation Example 3

The comparative colored particles were obtained in the same manner as in Comparative Colored Particle Preparation 1 except that C.I. Pigment Red 122 was employed instead of the carbon black. The resulting particles were termed "Comparative Colored Particle 3".

Comparative Colored Particle Preparation Example 4

The comparative colored particles were obtained in the same manner as in Comparative Colored Particle Preparation 1 except that C.I. Pigment Yellow 17 was employed instead of the carbon black. The resulting particles were termed "Comparative Colored Particle 4".

Evaluation

The following table shows various physical properties of "Dispersions 1 to 4", "Colored Particles 1 to 8" and "Comparative Colored Particles 1 to 4".

Furthermore, in terms of both volume average particle size and BET specific surface area, physical properties of Toners 1 to 8 and Comparative Toners 1 to 4 were almost the same as those corresponding to colored particles.

(Dispersion)

TABLE 1

| Sample | Number Average Primary Particle Size (μm) | Weight Average Molecular Weight (Mw) | Number Average Molecular Weight (Mn) | Mw/Mn |
|---|---|---|---|---|
| Dispersion 1 | 0.15 | $2.37 \times 10^4$ | $9.40 \times 10^3$ | 2.52 |
| Dispersion 2 | 0.32 | $1.75 \times 10^4$ | $8.61 \times 10^3$ | 2.03 |
| Dispersion 3 | 0.39 | $1.86 \times 10^4$ | $7.03 \times 10^3$ | 2.65 |
| Dispersion 4 | 0.47 | $1.78 \times 10^4$ | $8.10 \times 10^3$ | 2.20 |

TABLE 2

| Sample | Volume Average Particle Size (μm) | BET Specific Surface Area ($m^2/g$) |
|---|---|---|
| Colored Particle 1 | 5.9 | 23.1 |
| Colored Particle 2 | 6.2 | 24.2 |
| Colored Particle 3 | 5.7 | 36.2 |
| Colored Particle 4 | 5.8 | 38.7 |
| Colored Particle 5 | 6.3 | 18.6 |
| Colored Particle 6 | 8.4 | 17.9 |
| Colored Particle 7 | 6.5 | 31.7 |
| Colored Particle 8 | 5.5 | 27.1 |
| Comparative Colored Particle 1 | 5.9 | 3.2 |
| Comparative Colored Particle 2 | 6.0 | 3.3 |
| Comparative Colored Particle 3 | 6.1 | 3.9 |
| Comparative Colored Particle 4 | 5.7 | 3.8 |

Toner and Developer Preparation Example

As shown in the following table, the above-mentioned colored particles and 1 weight percent of the hydrophobic particles were mixed followed by agitation by the Henschel mixer and toners were prepared. Furthermore, "Toners 1 to 8" and "Comparative Toners 1 to 8" shown below were mixed with a carrier prepared by covering the surface of copper-zinc ferrite particles (volume average particle size= 45 μm) with a styrene-acryl resin. Furthermore, as to "Toners 9 to 12" and "Comparative Toners 9 to 12", were mixed with a carrier prepared by covering the aforesaid ferrite toner with a fluorinated vinylidene-tertafluoroethylene copolymer. In each resulting mixture, the concentration of the toner was adjusted to 5 weight percent and developers were prepared. Moreover, resulting developers were termed "Developers 1 to 12" and "Comparative Developers 1 to 12" corresponding to "Toners 1 to 12" and Comparative "Toners 1 to 12", respectively.

TABLE 3

| Toner No. | Colored Particle No. | Hydrophobic Particle No. |
|---|---|---|
| Toner 1 | Colored Particle 1 | Hydrophobic Silica 1 |
| Toner 2 | Colored Particle 2 | Hydrophobic Silica 2 |

TABLE 3-continued

| Toner No. | Colored Particle No. | Hydrophobic Particle No. |
|---|---|---|
| Toner 3 | Colored Particle 3 | Hydrophobic Silica 3 |
| Toner 4 | Colored Particle 4 | Hydrophobic Silica 5 |
| Toner 5 | Colored Particle 5 | Hydrophobic Silica 1 |
| Toner 6 | Colored Particle 6 | Hydrophobic Silica 1 |
| Toner 7 | Colored Particle 7 | Hydrophobic Silica 1 |
| Toner 8 | Colored Particle 8 | Hydrophobic Silica 1 |
| Toner 9 | Colored Particle 5 | Hydrophobic Silica 4 |
| Toner 10 | Colored Particle 6 | Hydrophobic Silica 4 |
| Toner 11 | Colored Particle 7 | Hydrophobic Silica 4 |
| Toner 12 | Colored Particle 8 | Hydrophobic Silica 4 |
| Comparative Toner 1 | Comparative Colored Particle 1 | Hydrophobic Silica 1 |
| Comparative Toner 2 | Comparative Colored Particle 2 | Hydrophobic Silica 2 |
| Comparative Toner 3 | Comparative Colored Particle 3 | Hydrophobic Silica 3 |
| Comparative Toner 4 | Comparative Colored Particle 4 | Hydrophobic Silica 5 |
| Comparative Toner 5 | Colored Particle 1 | Comparative Silica 1 |
| Comparative Toner 6 | Colored Particle 2 | Comparative Silica 1 |
| Comparative Toner 7 | Colored Particle 3 | Comparative Silica 1 |
| Comparative Toner 8 | Colored Particle 4 | Comparative Silica 1 |
| Comparative Toner 9 | Colored Particle 1 | Comparative Silica 2 |
| Comparative Toner 10 | Colored Particle 2 | Comparative Silica 2 |
| Comparative Toner 11 | Colored Particle 3 | Comparative Silica 2 |
| Comparative Toner 12 | Colored Particle 4 | Comparative Silica 2 |

(Evaluation)

Evaluation was performed using the aforementioned imaging method (imaging method shown in FIG. 3 was used.). This method is an imaging method wherein yellow, magenta, cyan and black developers are superimposed on the surface of a photoreceptor. Combined developers used were "Developers 1 to 4", "Developers 5 to 8", "Developers 9 to 12", "Comparative Developers 1 to 4", "Comparative Developers 5 to 8", "Comparative developers 9 to 12". Furthermore, for "Developers 9 to 12" and "Comparative Developers 9 to 12", a positively charged light-sensitive member was employed as a photoreceptor. For the others, a negatively charged light-sensitive member was used. Incidentally, the imaging method utilized a reversal development method.

The evaluation was conducted under the ambient condition of low temperature and low humidity (10° C., 20 percent relative humidity) and of high temperature and high humidity (33° C., 85 percent relative humidity) regarding the changes in the electrification amount and developability. The results are shown below.

The electrification amounts measured by a Blow-off method are shown. By measuring the amount of a toner adhered onto a photoreceptor, developability is represented as the amount of the developed toner per unit area ($mg/cm^2$).

TABLE 4

| | Electrification Amount (μc/g) | | Developability ($mg/cm^2$) | |
|---|---|---|---|---|
| Toner No. | Low Temperature, Low Humidity | High Temperature, High Humidity | Low Temperature, Low Humidity | High Temperature, High Humidity |
| Toner 1 | −28.5 | −28.5 | 1.01 | 1.01 |
| Toner 2 | −26.8 | −26.8 | 1.09 | 1.09 |
| Toner 3 | −27.3 | −27.3 | 1.07 | 1.07 |
| Toner 4 | −27.4 | −27.4 | 1.04 | 1.04 |
| Toner 5 | −28.3 | −28.3 | 1.09 | 1.09 |

TABLE 4-continued

| Toner No. | Electrification Amount (μc/g) Low Temperature, Low Humidity | Electrification Amount (μc/g) High Temperature, High Humidity | Developability (mg/cm²) Low Temperature, Low Humidity | Developability (mg/cm²) High Temperature, High Humidity |
|---|---|---|---|---|
| Toner 6 | −26.7 | −26.7 | 1.08 | 1.08 |
| Toner 7 | −27.3 | −27.3 | 1.07 | 1.07 |
| Toner 8 | −27.4 | −27.4 | 1.03 | 1.03 |
| Toner 9 | +25.3 | +25.3 | 1.05 | 1.05 |
| Toner 10 | +24.3 | +24.3 | 1.09 | 1.09 |
| Toner 11 | +24.6 | +24.6 | 1.07 | 1.07 |
| Toner 12 | +24.3 | +24.3 | 1.08 | 1.08 |
| Comparative Toner 1 | −17.5 | −21.5 | 1.22 | 0.98 |
| Comparative Toner 2 | −15.6 | −22.6 | 1.24 | 0.97 |
| Comparative Toner 3 | −15.3 | −22.3 | 1.27 | 0.95 |
| Comparative Toner 4 | −15.1 | −21.1 | 1.28 | 0.99 |
| Comparative Toner 5 | −26.8 | −21.0 | 1.18 | 0.89 |
| Comparative Toner 6 | −25.3 | −19.3 | 1.18 | 0.89 |
| Comparative Toner 7 | −25.8 | −18.1 | 1.19 | 0.87 |
| Comparative Toner 8 | −25.5 | −17.5 | 1.19 | 0.88 |
| Comparative Toner 9 | +23.1 | +13.9 | 1.20 | 0.91 |
| Comparative Toner 10 | +22.7 | +13.6 | 1.21 | 0.92 |
| Comparative Toner 11 | +22.1 | +16.5 | 1.21 | 0.92 |
| Comparative Toner 12 | +21.1 | +16.9 | 1.22 | 0.91 |

As shown in results in Table 4 above, it is found that regarding the toners of the present invention, no variation is caused due to the ambient changes and consistent images can be prepared.

Example 2

Colored Particle Preparation Example 11

To a solution prepared by dissolving 4.92 g of sodium dodecylsulfate into 120 ml of pure water, was added 10.67 g of the compound obtained by treating the carbon black (Morgal L manufactured by Cabot Corp.) with the aluminum coupling agent (Plainact A1-M manufactured by Ajinomoto Co. Ltd.) followed by stirring under ultrasonic wave and an aqueous carbon black dispersion was prepared. In addition, low molecular weight polypropylene (number average molecular weight=3,200) was dispersed into water having a surface active agent under heating and an emulsified dispersion having a solid portion concentration of 20 weight percent was prepared. With the aforesaid carbon black dispersion was mixed 43 g of the low molecular polypropylene emulsified dispersion, further, 98.1 g of styrene monomer, 18.4 g of n-butylmethacrylate monomer, 6.1 g of methacrylic acid monomer, 3.3 g of t-dodecylmercaptan and 850 ml of deaerated pure water. The resulting mixture was raised to 70° C. with stirring under nitrogen gas flow. Then, 200 ml of pure water to which 4.1 g of potassium persulfate had been dissolved was added and the resulting mixture underwent reaction at 70° C. for 6 hours. The resulting colored particle dispersion comprising the carbon black was termed "Dispersion 11". The primary particle size of the dispersion was measured (Light Scattering Electrophoretic Particle Diameter Measuring Apparatus ELS-800 manufactured by Ohtsuka Denshi Kogyo Co., Ltd.) and the molecular weight distribution was also measured (GPC was used; styrene-based converted molecular weight). Table 5 in the following shows results. To 600 ml of this "Dispersion 11", were added 160 ml of 2.7 mole percent of potassium chloride aqueous solution, furthermore, 94 ml of isopropyl alcohol, 40 ml of pure water to which 5.4 g of polyoxyethyleneoctylphenyl ether (average polymerization degree of ethylene oxide is 10). Then, the temperature was raised up to 85° C. and the reaction was conducted for 6 hours. After the completion of the reaction, the resulting solution was filtrated, washed and dried and the colored particles of the present invention were obtained. The resulting particles were termed "Colored Particle 11".

Colored Particle Preparation Example 12

The colored particles of the present invention were obtained in the same manner as in Colored Particle Preparation Example 11 except that C.I. Pigment Blue 15:3 was used instead of the surface treated carbon black. Further, the resulting dispersion was termed "Dispersion 12" and the resulting colored particles were termed "Colored Particle 12".

Colored Particle Preparation Example 13

The colored particles of the present invention were prepared in the same manner as in Colored Particle Preparation Example 11 except that C.I. Pigment Red 122 was employed instead of the surface treated carbon black. Further, the resulting dispersion was termed "Dispersion 13" and the resulting colored particles were termed "Colored Particle 13".

Colored Particle Preparation Example 14

The colored particles of the present invention were prepared in the same manner as in Colored Particle Preparation Example 1 except that C.I. Pigment Yellow 17 was employed instead of the surface treated carbon black. Further, the resulting dispersion was termed "Dispersion 14" and the resulting colored particles were termed "Colored Particle 14".

Colored Particle Preparation Example 15

The colored particles of the present invention were prepared in the same manner as in Colored Particle Preparation Example 11 except that "Dispersion 11" was employed and the volume of isopropyl alcohol added was 125 ml. The resulting particles were termed "Colored Particle 15".

Comparative Colored Particle Preparation Example 11

To 100 parts of styrene-n-butylacrylate copolymer (copolymerization ratio=85:15, weight average molecular weight=63,000) were added 10 parts of carbon black, 5 parts of low molecular weight polypropylene (number average molecular weight=3,200), and the resulting mixture was kneaded followed by pulverization and classification and the comparative colored particles were obtained. The resulting particles were termed "Comparative Colored Particle 11".

Comparative Colored Particle Preparation Example 12

The comparative colored particles were obtained in the same manner as in Comparative Colored Particle Preparation Example 11 except that C.I. Pigment Blue 15:3 was employed instead of the carbon black. The resulting particles were termed "Comparative Colored Particle 12".

Comparative Colored Particle Preparation Example 13

The comparative colored particles were obtained in the same manner as in Comparative Colored Particle Preparation 11 except that C.I. Pigment Red 122 was employed instead of the carbon black. The resulting particles were termed "Comparative Colored Particle 13".

Comparative Colored Particle Preparation Example 14

The comparative colored particles were obtained in the same manner as in Comparative Colored Particle Preparation 11 except that C.I. Pigment Yellow 17 was employed instead of the carbon black. The resulting particles were termed "Comparative Colored Particle 14".

Evaluation

Table 5 and Table 6 in the following show various physical properties of the above-mentioned "Dispersions 11 to 14", "Colored Particles 11 to 15" and "Comparative Colored Particles 11 to 14".

TABLE 5

| Sample | Number Average Primary Particle Size (μm) | Weight Average Molecular Weight (Mw) | Number Average Molecular Weight (Mn) | Mw/Mn |
|---|---|---|---|---|
| Dispersion 11 | 0.18 | $2.07 \times 10^4$ | $9.50 \times 10^3$ | 2.18 |
| Dispersion 12 | 0.25 | $1.85 \times 10^4$ | $8.81 \times 10^3$ | 2.10 |
| Dispersion 13 | 0.32 | $1.66 \times 10^4$ | $7.23 \times 10^3$ | 2.30 |
| Dispersion 14 | 0.48 | $1.98 \times 10^4$ | $8.79 \times 10^3$ | 2.26 |

TABLE 6

| Colored Particle No. | Volume Average Particle Size (μm) | BET Specific Surface Area ($m^2/g$) |
|---|---|---|
| Colored Particle 11 | 5.9 | 23.1 |
| Colored Particle 12 | 6.2 | 24.2 |
| Colored Particle 13 | 5.7 | 36.2 |
| Colored Particle 14 | 5.8 | 38.7 |
| Colored Particle 15 | 6.3 | 18.6 |
| Comparative Colored Particle 11 | 5.9 | 3.2 |
| Comparative Colored Particle 12 | 6.0 | 3.3 |
| Comparative Colored Particle 13 | 6.1 | 3.9 |
| Comparative Colored Particle 14 | 5.7 | 3.8 |

Furthermore, Table 7 below shows hydrophobic particles employed.

TABLE 7

| Hydrophobic Particle No. | Number Average Primary Particle Size (nm) | Composition |
|---|---|---|
| Hydrophobic Particle 11 | 6 | Hydrophobic Silica treated with dimethylchlorosilane |
| Hydrophobic Particle 12 | 18 | Hydrophobic silica treated with trimethoxyoctylsilane |
| Hydrophobic Particle 13 | 26 | Hydrophobic alumina treated with hexamethyldisilazane |
| Hydrophobic Particle 14 | 68 | Hydrophobic silica treated with hexamethyldisilazane |
| Hydrophobic Particle 15 | 15 | Hydrophobic titania treated with trimethoxyoctylsilane |
| Hydrophobic Particle 16 | 250 | P-MMA particles |
| Hydrophobic Particle 17 | 890 | Strontium titanate particles |
| Hydrophobic Particle 18 | 1200 | P-ST particles |
| Comparative Hydrophobic Particle 11 | 2200 | P-MMA particles |

The toners shown in Table 8 below were obtained by adding hydrophobic particles shown in Table 7 to the above-mentioned colored particles and comparative colored particles. Furthermore, mixing was conducted with the use of the Henschel mixer at a stirring peripheral speed of 40 m/second.

TABLE 8

| Toner | | Particle Size of Toner (μm) | Density of Toner ($g/cm^3$) | BET Value of Toner ($m^2/g$) | External Additive A | Density of External Additive ($g/cm^3$) | Particle Size (μm) | Addition Amount (wt %) | Coverage (%) |
|---|---|---|---|---|---|---|---|---|---|
| Example 2-1 | Colored Particle 11 | 5.9 | 1.1 | 23.1 | Hydrophobic Particle 11 | 2.2 | 0.006 | 6 | 65.03 |
| Example 2-2 | Colored Particle 12 | 6.2 | 1.1 | 24.2 | Hydrophobic Particle 12 | 2.2 | 0.018 | 5 | 20.65 |
| Example 2-3 | Colored Particle 13 | 5.7 | 1.1 | 36.2 | Hydrophobic Particle 13 | 2.2 | 0.018 | 5 | 15.46 |
| Exmaple 2-4 | Colored Particle 14 | 5.8 | 1.1 | 38.7 | Hydrophobic Particle 11 | 2.2 | 0.006 | 5 | 34.36 |
| Example 2-5 | Colored Particle 15 | 6.3 | 1.1 | 18.6 | Hydrophobic Particle 13 | 4.0 | 0.026 | 6 | 15.31 |
| Example 2-6 | Colored Particle 15 | 6.3 | 1.1 | 18.6 | Hydrophobic Particle 14 | 2.2 | 0.068 | 3 | 6.23 |
| Example 2-7 | Colored Particle 15 | 6.3 | 1.1 | 18.6 | Hydrophobic Particle 15 | 4.2 | 0.125 | 10 | 13.07 |
| Example 2-8 | Colored Particle 15 | 6.3 | 1.1 | 18.6 | Hydrophobic Particle 16 | 1.1 | 0.250 | 10 | 15.87 |
| Example 2-9 | Colroed Particle 15 | 6.3 | 1.1 | 18.6 | Hydrophobic Particle 17 | 3.3 | 0.890 | 10 | 10.55 |
| Example 2-10 | Colored Particle 15 | 6.3 | 1.1 | 18.6 | Hydrophobic Particle 18 | 1.0 | 1.200 | 15 | 17.02 |
| Example 2-11 | Colored Particle 11 | 5.9 | 1.1 | 23.1 | Hydrophobic Particle 11 | 2.2 | 0.006 | 0.3 | 3.25 |
| Example 2-12 | Colored Particle 11 | 5.9 | 1.1 | 23.1 | Hydrophobic Particle 11 | 2.2 | 0.006 | 8 | 86.71 |

TABLE 8-continued

| Toner | | Particle Size of Toner (μm) | Density of Toner (g/cm³) | BET Value of Toner (m²/g) | External Additive A | Density of External Additive (g/cm³) | Particle Size (μm) | Addition Amount (wt %) | Coverage (%) |
|---|---|---|---|---|---|---|---|---|---|
| Comparative Example 2-1 | Comparative Colored Particle 11 | 5.9 | 1.1 | 3.2 | Hydrophobic Particle 14 | 4.2 | 0.030 | 3 | 25.32 |
| Comparative Example 2-2 | Comparative Colored Particle 12 | 6.0 | 1.1 | 3.3 | Hydrophobic Particle 14 | 2.2 | 0.068 | 3 | 21.23 |
| Comparative Example 2-3 | Comparative Colored Particle 13 | 6.1 | 1.1 | 3.9 | Hydrophobic Particle 14 | 2.2 | 0.068 | 3 | 18.46 |
| Comparative Example 2-4 | Comparative Colored Particle 14 | 5.7 | 1.1 | 3.8 | Hydrophobic Particle 14 | 2.2 | 0.068 | 3 | 18.83 |
| Comparative Example 2-5 | Colored Particle 11 | 5.9 | 1.1 | 23.1 | Comparative Hydrophobic Particle 11 | 1.1 | 2.200 | 5 | 5.27 |

Developer Preparation Example

Furthermore, as to "Toners 2-1 to 2-12" and "Comparative Toners 2-1 to 2-5", are mixed carriers prepared by covering copper-zinc ferrite (volume average particle size= 45 μm) with a styrene-acryl resin and developers having a toner concentration of 5 weight percent were prepared. Further, developers comprising "Toners 2-1 to 2-12" were termed "Developers 2-1 to 2-12" and developers comprising Comparative "Toner 2-1 to 2-5" were termed Comparative "Developers 2-1 to 2-5".

(Evaluation)

Combinations of the developers are "Developers 2-1 to 2-4", "Comparative Developers 2-1 to 2-4". In the combinations of "Developers 2-5 to 2-12" and "Comparative Developer 2-5", the black developer was only employed.

FIG. 3 shows a basic mechanism of a used imaging apparatus (Konica 9028 manufactured by Konica Corp.). The apparatus employs a negatively charged photoreceptor and a reversal developing method.

The evaluation was conducted under the ambient condition of low temperature and low humidity (10° C., 20 percent relative humidity) and high temperature and high humidity (33° C. and 85 percent relative humidity) regarding the charges in the electrification amount and developability. The results are shown Table 9 in the following.

The electrification amounts measured by a Blow-off method are shown. By measuring the amount of a toner adhered onto a photoreceptor, developability is represented as the amount of the developed toner per unit area (mg/cm²).

TABLE 9

| Developer | Charge Amount | | Developed Amount | | Stability Difference of Developed Amount for |
|---|---|---|---|---|---|
| | At 10° C., 20% RH (μC/g) | At 33° C., 85% RH (μC/g) | 10° C., 20% RH (mg/cm²) | 33° C., 85% RH (mg/cm²) | Ambient Changes (mg/cm²) |
| Example 2-1 | 25.4 | 26.4 | 0.99 | 0.95 | 0.04 |
| Example 2-2 | 26.6 | 27.1 | 0.95 | 0.93 | 0.02 |

TABLE 9-continued

| Developer | Charge Amount | | Developed Amount | | Stability Difference of Developed Amount for |
|---|---|---|---|---|---|
| | At 10° C., 20% RH (μC/g) | At 33° C., 85% RH (μC/g) | 10° C., 20% RH (mg/cm²) | 33° C., 85% RH (mg/cm²) | Ambient Changes (mg/cm²) |
| Example 2-3 | 26.8 | 27.3 | 0.94 | 0.92 | 0.02 |
| Example 2-4 | 29.3 | 29.2 | 0.86 | 0.86 | 0.00 |
| Example 2-5 | 27.7 | 27.8 | 0.91 | 0.90 | 0.01 |
| Example 2-6 | 26.5 | 27.3 | 0.95 | 0.92 | 0.03 |
| Example 2-7 | 26.9 | 27.7 | 0.93 | 0.91 | 0.02 |
| Example 2-8 | 24.8 | 25.3 | 1.01 | 0.99 | 0.02 |
| Example 2-9 | 27.3 | 27.9 | 0.92 | 0.90 | 0.02 |
| Example 2-10 | 24.4 | 25.1 | 1.03 | 1.00 | 0.03 |
| Example 2-11 | 22.3 | 25.6 | 1.08 | 1.00 | 0.08 |
| Example 2-12 | 27.8 | 29.4 | 0.94 | 0.86 | 0.08 |
| Comparative Example 2-1 | 9.1 | 32.4 | 2.76 | 0.78 | 1.98 |
| Comparative Example 2-2 | 8.2 | 38.3 | 3.07 | 0.66 | 2.41 |
| Comparative Example 2-3 | 11.3 | 29.9 | 2.23 | 0.84 | 1.39 |
| Comparative Example 2-4 | 6.7 | 27.9 | 3.75 | 0.90 | 2.85 |
| Comparative Example 2-5 | 15.8 | 28.3 | 1.59 | 0.89 | 0.70 |

In Table 9, it is found that examples of the present invention have no problem and on the other hand, comparative examples not within the scope of the present invention causes problems in the properties.

Example 3

Colored Particle Preparation Example 31

To a solution prepared by dissolving 4.92 g of sodium dodecylsulfate into 120 ml of pure water, was added 10.67 g of the compound obtained by treating the carbon black (Morgal L manufactured by Cabot Corp.) with the aluminum coupling agent (Plainact A1-M manufactured by Ajinomoto Co. Ltd.) followed by stirring under ultrasonic wave and an aqueous carbon black dispersion was prepared. In addition, low molecular weight polypropylene (number average molecular weight=3,200) was dispersed into water having a surface active agent under heating and an emulsified dispersion having a solid portion concentration of 20 weight percent was prepared. With the aforesaid carbon black dispersion was mixed 43 g of the low molecular polypropylene emulsified dispersion, further, 98.1 g of styrene monomer, 18.4 g of n-butylmethacrylate monomer, 6.1 g of methacrylic acid monomer, 3.3 g of t-dodecylmercaptan and 850 ml of deaerated pure water and then, the temperature of the resulting mixture was raised to 70° C. with stirring under nitrogen gas flow. Then, 200 ml of pure water to which 4.1 g of potassium persulfate had been dissolved was added and the resulting mixture underwent reaction at 70° C. for 6 hours. The resulting colored particle dispersion comprising the carbon black was termed "Dispersion 31". The primary particle size of the dispersion was measured (Light Scattering Electrophoretic Particle Diameter Measuring Apparatus ELS-800 manufactured by Ohtsuka Denshi Kogyo Co., Ltd.) and the molecular weight distribution was also measured (GPC was used; styrene-based converted molecular weight). Table 10 in the following shows results. To 600 ml of this "Dispersion 31", were added 160 ml of 2.7 mole percent of aqueous potassium chloride solution, furthermore, 94 ml of isopropyl alcohol, 40 ml of pure water to which 5.4 g of polyoxyethyleneoctylphenyl ether (average polymerization degree of ethylene oxide is 10). Then, the temperature was raised up to 85° C. and the reaction was conducted for 6 hours. After the completion of the reaction, the resulting solution was filtrated, washed and dried and the colored particles of the present invention were obtained. The resulting particles were termed "Colored Particle 31".

Colored Particle Preparation Example 32

The colored particles of the present invention were prepared in the same manner as in Colored Particle Preparation Example 31 except that C.I. Pigment Blue 15:3 was employed instead of the surface treated carbon black. Further, the resulting dispersion was termed "Dispersion 32" and the resulting colored particles were termed "Colored Particle 32".

Colored Particle Preparation Example 33

The colored particles of the present invention were prepared in the same manner as in Colored Particle Preparation Example 31 except that C.I. Pigment Red 122 was employed instead of the surface treated carbon black. Further, the resulting dispersion was termed "Dispersion 33" and the resulting colored particles were termed "Colored Particle 33".

Colored Particle Preparation Example 34

The colored particles of the present invention were prepared in the same manner as in Colored Particle Preparation Example 31 except that C.I. Pigment Yellow 17 was employed instead of the surface treated carbon black. Further, the resulting dispersion was termed "Dispersion 34" and the resulting colored particles were termed "Colored Particle 34".

Colored Particle Preparation Example 35

The colored particles of the present invention were prepared in the same manner as in Colored Particle Preparation Example 31 except that "Dispersion 31" was employed and the volume of isopropyl alcohol added was 125 ml. The resulting particles were termed "Colored Particle 35".

Colored Particle Preparation Example 36

The colored particles of the present invention were prepared in the same manner as in Colored Particle Preparation Example 31 except that "Dispersion 31" was employed and the volume of 2.7 mole percent of an aqueous potassium chloride solution added was 250 ml. The resulting particles were termed "Colored Particle 36".

Colored Particle Preparation Example 37

The colored particles of the present invention were prepared in the same manner as in Colored Particle Preparation Example 31 except that "Dispersion 31" was employed and the volume of isopropyl alcohol added was 72 ml and the volume of 2.7 mole percent of an aqueous potassium chloride solution added was 200 ml. The resulting particles were termed "Colored Particle 37".

Colored Particle Preparation Example 38

The colored particles of the present invention were prepared in the same manner as in Colored Particle Preparation Example 31 except that "Dispersion 31" was employed and the volume of isopropyl alcohol added was 60 ml and the volume of 2.7 mole percent of an aqueous potassium chloride solution added was 180 ml. The resulting particles were termed "Colored Particle 38".

Comparative Colored Particle Preparation Example 31

To 100 parts of styrene-n-butylacrylate copolymer (copolymerization ratio=85:15, weight average molecular weight=63,000) were added 10 parts of a carbon black, 5 parts of low molecular weight polypropylene (number average molecular weight=3,200), and the resulting mixture was kneaded, followed by pulverization and classification and the comparative colored particles were obtained. The resulting particles were termed "Comparative colored Particle 31".

Evaluation

Table 10 and Table 11 below show various physical properties of the above-mentioned "Dispersions 31 to 34", "Colored Particles 31 to 38" and "Comparative Colored Particles 31".

TABLE 10

| Sample | Number Average Primary Particle Size (μm) | Weight Average Molecular Weight (Mw) | Number Average Molecular Weight (Mn) | Mw/Mn |
|---|---|---|---|---|
| Dispersion 31 | 0.18 | $2.07 \times 10^4$ | $9.50 \times 10^3$ | 2.18 |
| Dispersion 32 | 0.25 | $1.85 \times 10^4$ | $8.81 \times 10^3$ | 2.10 |
| Dispersion 33 | 0.32 | $1.66 \times 10^4$ | $7.23 \times 10^3$ | 2.30 |
| Dispersion 34 | 0.48 | $1.98 \times 10^4$ | $8.79 \times 10^3$ | 2.26 |

TABLE 11

| Sample | Volume Average Particle Size (μm) | BET Specific Surface Area ($m^2/g$) |
|---|---|---|
| Colored Particle 31 | 5.6 | 22.1 |
| Colored Particle 32 | 5.3 | 20.4 |
| Colored Particle 33 | 5.2 | 24.6 |
| Colored Particle 34 | 5.5 | 28.7 |
| Colored Particle 35 | 6.2 | 15.6 |
| Colored Particle 36 | 8.4 | 18.9 |

TABLE 11-continued

| Sample | Volume Average Particle Size (μm) | BET Specific Surface Area ($m^2/g$) |
|---|---|---|
| Colored Particle 37 | 5.7 | 34.7 |
| Colored Particle 38 | 5.8 | 29.1 |
| Comparative Colored Particle 31 | 5.9 | 3.2 |

Furthermore, Table 12 below shows hydrophobic particles used.

TABLE 12

| Hydrophobic Particle No. | Specific Surface Area ($m^2/g$) | Number Average Primary Particle Size (nm) | Remarks |
|---|---|---|---|
| Hydrophobic Particle 31 | 33 | 102 | Titanium oxide treated with trimethoxyoctylsilane |
| Hydrophobic Particle 32 | 55 | 110 | Titanium oxide treated with trimethoxyoctylsilane |
| Hydrophobic Particle 33 | 55 | 85 | Titanium oxide treated with hexamethyldisilazane |
| Hydrophobic Particle 34 | 55 | 97 | Titanium oxide treated with trimethoxyoctylsilane |
| Hydrophobic Particle 35 | 135 | 15 | Silica treated with trimethoxyoctylsilane |
| Hydrophobic Particle 36 | 180 | 7 | Silica treated with hexamethyldisilazane |

Toners were prepared by combining these hydrophobic particles with above-mentioned colored particles. In the following, preparation examples are shown.

TABLE 13

| | | Toner Particle Size (μm) | Density of Toner ($g/cm^3$) | BET Value of Toner ($m^2/g$) |
|---|---|---|---|---|
| Example 3-1 | Colored Particle 31 | 5.6 | 1.1 | 22.1 |
| Example 3-2 | Colored Particle 32 | 5.3 | 1.1 | 20.4 |
| Example 3-3 | Colored Particle 33 | 5.2 | 1.1 | 24.6 |
| Example 3-4 | Colored Particle 34 | 5.5 | 1.1 | 28.7 |
| Example 3-5 | Colored Particle 35 | 6.2 | 1.1 | 15.6 |
| Example 3-6 | Colored Particle 36 | 8.4 | 1.1 | 18.9 |
| Example 3-7 | Colored Particle 37 | 5.7 | 1.1 | 34.7 |
| Example 3-8 | Colored Particle 38 | 5.8 | 1.1 | 29.1 |
| Example 3-9 | Colored Particle 31 | 5.6 | 1.1 | 22.1 |
| Example 3-10 | Colored Particle 31 | 5.6 | 1.1 | 22.1 |
| Comparative Example 3-1 | Comparative Colored Particle 31 | 5.9 | 1.1 | 3.20 |

TABLE 14

| | External Additive A | Density of External Additive ($g/cm^3$) | Particle Size (μm) | Addition Amount (wt %) | Coverage (%) | External Additive B | Density of External Additive ($g/cm^3$) | Particle Diameter (μm) | Addition Amount (wt %) | Coverage (%) | Coverage Total (%) |
|---|---|---|---|---|---|---|---|---|---|---|---|
| Example 3-1 | Hydrophobic Particle 31 | 4.2 | 0.102 | 5 | 6.58 | Hydrophobic Particle 35 | 2.2 | 0.015 | 2 | 10.23 | 16.81 |
| Example 3-2 | Hydrophobic Particle 31 | 4.2 | 0.102 | 5 | 6.72 | Hydrophobic Particle 35 | 2.2 | 0.015 | 2 | 10.91 | 17.63 |
| Example 3-3 | Hydrophobic Particle 31 | 4.2 | 0.102 | 5 | 6.42 | Hydrophobic Particle 35 | 2.2 | 0.015 | 2 | 9.39 | 15.81 |
| Example 3-4 | Hydrophobic Particle 31 | 4.2 | 0.102 | 5 | 6.22 | Hydrophobic Particle 35 | 2.2 | 0.015 | 2 | 8.34 | 14.56 |
| Example 3-5 | Hydrophobic Particle 32 | 4.2 | 0.110 | 4 | 5.67 | Hydrophobic Particle 35 | 2.2 | 0.015 | 3 | 20.48 | 26.15 |
| Example 3-6 | Hydrophobic Particle 33 | 4.2 | 0.085 | 4 | 5.78 | Hydrophobic Particle 35 | 2.2 | 0.015 | 3 | 17.43 | 23.21 |
| Example 3-7 | Hydrophobic Particle 34 | 4.2 | 0.097 | 4 | 4.85 | Hydrophobic Particle 36 | 2.2 | 0.007 | 3 | 19.84 | 24.69 |
| Example 3-8 | Hydrophobic Particle 32 | 4.2 | 0.110 | 5 | 6.12 | Hydrophobic Particle 36 | 2.2 | 0.007 | 4 | 30.78 | 36.9 |
| Example 3-9 | Hydrophobic Particle 31 | 4.2 | 0.102 | 1 | 1.32 | Hydrophobic Particle 35 | 2.2 | 0.015 | 0.3 | 1.53 | 2.85 |
| Example 3-10 | Hydrophobic Particle 31 | 4.2 | 0.102 | 10 | 13.17 | Hydrophobic Particle 35 | 2.2 | 0.015 | 15 | 76.7 | 89.87 |
| Comparative Example 3-1 | Hydrophobic Particle 31 | 4.2 | 0.102 | 3 | 9.57 | Hydrophobic Particle 35 | 2.2 | 0.015 | 1 | 29.41 | 38.98 |

Developers were prepared by mixing the above-mentioned toner with a carrier (45 μm of volume average particle size) covered by a styrene-acryl resin so that the concentration of the toner was 5.9 weight percent.

The evaluation was performed by using the Konica DC-7728 manufactured by Konica Corp. and a non-contact developing method. Furthermore, as a photoreceptor, a lamination-type organic photoreceptor was used and the development was performed by the reversal development. Moreover, a blade cleaning method was utilized as the cleaning method.

In order to evaluate the rising properties of the development, the evaluation was performed at the ambient conditions of high temperature and high humidity (33 C., 85% relative humidity), and a solid black image was copied and the difference in density between the upper part and the lower part was measured. The image density was measured by the Mcbeth Reflection Densitometer and the difference in density between the upper part and the lower part was shown. Results are shown in Table 15 below.

TABLE 15

| | Difference in Density at Upper and Lower Sides (−) |
|---|---|
| Example 3-1 | 0.00 |
| Example 3-2 | 0.00 |
| Example 3-3 | 0.00 |
| Example 3-4 | 0.00 |
| Example 3-5 | 0.00 |
| Example 3-6 | 0.00 |
| Example 3-7 | 0.00 |
| Example 3-8 | 0.00 |
| Example 3-9 | 0.02 |
| Example 3-10 | 0.03 |
| Comparative Example 3-1 | 0.12 |

As shown in Table 15, Toners 3-1 and 3-10 of the present invention show clearly smaller differences in density at upper and lower sides.

Example 4

Colored Particle Preparation Example 41

To a solution prepared by dissolving 4.92 g of sodium dodecylsulfate into 120 ml of pure water, was added 10.67 g of the compound obtained by treating the carbon black (Morgal L manufactured by Cabot Corp.) with the aluminum coupling agent (Plainact A1-M manufactured by Ajinomoto Co. Ltd.) followed by stirring under ultrasonic wave and an aqueous carbon black dispersion was prepared. In addition, low molecular weight polypropylene (number average molecular weight=3,200) was dispersed into water having a surface active agent under heating and an emulsified dispersion having a solid portion concentration of 20 weight percent was prepared. With the aforesaid carbon black dispersion is mixed 43 g of the low molecular polypropylene emulsified dispersion, further, 98.1 g of styrene monomer, 18.4 g of n-butylmethacrylate monomer, 6.1 g of methacrylic acid monomer, 3.3 g of t-dodecylmercaptan and 850 ml of deaerated pure water and the temperature of the resulting mixture was raised to 70° C. with stirring under nitrogen gas flow. Then, 200 ml of pure water to which 4.1 g of potassium persulfate had been dissolved was added and the resulting mixture underwent reaction at 70° C. for 6 hours. The resulting colored particle dispersion comprising the carbon black is termed "Dispersion 41". The primary particle size of the dispersion was measured (Light Scattering Electrophoretic Particle Diameter Measuring Apparatus ELS-800 manufactured by Ohtsuka Denshi Kogyo Co., Ltd.) and the molecular weight distribution was also measured (GPC was used; styrene-based converted molecular weight). Table 16 in the following shows results. To 600 ml of this "Dispersion 41", were added 160 ml of 2.7 mole percent of aqueous potassium chloride solution, furthermore, 94 ml of isopropyl alcohol, and 40 ml of pure water to which 5.4 g of polyoxyethyleneoctylphenyl ether (average polymerization degree of ethylene oxide is 10) is dissolved. Then, the temperature was raised up to 85° C. and the reaction was conducted for 6 hours. After the completion of the reaction, the resulting solution was filtrated, washed and dried and the colored particles of the present invention were obtained. The resulting particles were termed "Colored Particle 41".

Colored Particle Preparation Example 42

The colored particles of the present invention were prepared in the same manner as in Colored Particle Preparation Example 41 except that C.I. Pigment Blue 15:3 was employed instead of the surface treated carbon black. Further, the resulting dispersion was termed "Dispersion 42" and the resulting colored particles were termed "Colored Particle 42".

Colored Particle Preparation Example 43

The colored particles of the present invention were prepared in the same manner as in Colored Particle Preparation Example 41 except that C.I. Pigment Red 122 was employed instead of the surface treated carbon black. Further, the resulting dispersion was termed "Dispersion 43" and the resulting colored particles were termed "Colored Particle 43".

Colored Particle Preparation Example 44

The colored particles of the present invention were prepared in the same manner as in Colored Particle Preparation Example 41 except that C.I. Pigment Yellow 17 was employed instead of the surface treated carbon black. Further, the resulting dispersion was termed "Dispersion 44" and the resulting colored particles were termed "Colored Particle 44".

Colored Particle Preparation Example 45

The colored particles of the present invention were prepared in the same manner as in Colored Particle Preparation Example 41 except that "Dispersion 41" was employed and the volume of isopropyl alcohol added was 125 ml. The resulting particles were termed "Colored Particle 45".

Colored Particle Preparation Example 46

The colored particles of the present invention were prepared in the same manner as in Colored Particle Preparation Example 41 except that "Dispersion 41" was employed and the volume of 2.7 mole percent of an aqueous potassium chloride solution added was 250 ml. The resulting particles were termed "Colored Particle 46".

Colored Particle Preparation Example 47

The colored particles of the present invention were prepared in the same manner as in Colored Particle Preparation Example 41 except that "Dispersion 31" was employed and the volume of isopropyl alcohol added was 72 ml and the volume of 2.7 mole percent of an aqueous potassium chloride solution added was 200 ml. The resulting particles were termed "Colored Particle 47".

Colored Particle Preparation Example 48

The colored particles of the present invention were prepared in the same manner as in Colored Particle Preparation Example 41 except that "Dispersion 31" was employed and the volume of isopropyl alcohol added was 60 ml and the volume of 2.7 mole percent of an aqueous potassium chloride solution added was 180 ml. The resulting particles were termed "Colored Particle 48".

Comparative Colored Particle Preparation Example 41

To 100 parts of styrene-n-butylacrylate copolymer (copolymer ratio=85:15, weight average molecular weight=63,000) were added 10 parts of a carbon black, 5 parts of low molecular weight polypropylene (number average molecular weight=3,200), and the resulting mixture was kneaded followed by pulverization and classification and the comparative colored particles were obtained. The resulting particles were termed "Comparative colored Particle 41".

Evaluation

Tables 16 and Table 17 below show various physical properties of the above-mentioned "Dispersions 41 to 44", "Colored Particles 41 to 48" and "Comparative Colored Particles 41".

TABLE 16

| Sample | Number Average Primary Particle Size (μm) | Weight Average Molecular Weight (Mw) | Number Average Molecular Weight (Mn) | Mw/Mn |
|---|---|---|---|---|
| Dispersion 41 | 0.18 | $2.07 \times 10^4$ | $9.50 \times 10^3$ | 2.18 |
| Dispersion 42 | 0.25 | $1.85 \times 10^4$ | $8.81 \times 10^3$ | 2.10 |
| Dispersion 43 | 0.32 | $1.66 \times 10^4$ | $7.23 \times 10^3$ | 2.30 |
| Dispersion 44 | 0.48 | $1.98 \times 10^4$ | $8.79 \times 10^3$ | 2.26 |

TABLE 17

| Sample | Volume Average Particle Size (μm) | BET Specific Surface Area ($m^2/g$) |
|---|---|---|
| Colored Particle 41 | 5.6 | 22.1 |
| Colored Particle 42 | 5.3 | 20.4 |
| Colored Particle 43 | 5.2 | 24.6 |
| Colored Particle 44 | 5.6 | 28.7 |
| Colored Particle 45 | 6.3 | 15.6 |
| Colored Particle 46 | 8.4 | 18.9 |
| Colored Particle 47 | 5.7 | 34.7 |
| Colored Particle 48 | 5.8 | 29.1 |
| Comparative Colored Particle 41 | 5.9 | 3.2 |

Furthermore, Table 18 below shows hydrophobic particles used.

TABLE 18

| Hydrophobic Particle No. | Number Average Primary Particle Size (nm) | Remarks |
|---|---|---|
| Hydrophobic Particle 41 | 6 | Hydrophobic silica treated with dimethylchlorosilane |
| Hydrophobic Particle 42 | 18 | Hydrophobic silica treated with trimethoxyoctylsilane |
| Hydrophobic Particle 43 | 26 | Hydrophobic alumina treated with hexamethyldisilazane |
| Hydrophobic Particle 44 | 68 | Hydrophobic silica treated with hexamethyldisilazane |
| Hydrophobic Particle 45 | 125 | Hydrophobic titania treated with trimethoxyoctylsilane |
| Hydrophobic Particle 46 | 250 | P-MMA particle |

TABLE 18-continued

| Hydrophobic Particle No. | Number Average Primary Particle Size (nm) | Remarks |
|---|---|---|
| Hydrophobic Particle 47 | 890 | Strontium titanate |
| Hydrophobic Particle 48 | 1200 | Cerium oxide |
| Comparative Hydrophobic Particle 41 | 2200 | P-MMA particle |

Hydrophobic particles shown in the above-mentioned Table 18 were added to the aforesaid colored particles and comparative colored particles and toners shown in Table 19 and Table 20 were obtained. Furthermore, mixing was conducted with the use of the Henschel mixer at a stirring peripheral speed of 40 m/second for 10 mins.

TABLE 19

| Sample No. | | Toner Particle Size (μm) | Density of Toner ($g/cm^3$) | BET Value of Toner ($m^2/g$) |
|---|---|---|---|---|
| Examine 4-1 | Colored Particle 41 | 5.6 | 1.1 | 22.1 |
| Example 4-2 | Colored Particle 42 | 5.3 | 1.1 | 20.4 |
| Example 4-3 | Colored Particle 43 | 5.2 | 1.1 | 24.6 |
| Example 4-4 | Colored Particle 44 | 5.6 | 1.1 | 28.7 |
| Example 4-5 | Colored Particle 45 | 6.3 | 1.1 | 15.6 |
| Example 4-6 | Colored Particle 46 | 8.4 | 1.1 | 18.9 |
| Example 4-7 | Colored Particle 47 | 5.7 | 1.1 | 34.7 |
| Example 4-8 | Colored Particle 48 | 5.8 | 1.1 | 29.1 |
| Example 4-9 | Colored Particle 48 | 5.8 | 1.1 | 29.1 |
| Example 4-10 | Colored Particle 48 | 5.8 | 1.1 | 29.1 |
| Example 4-11 | Colored Particle 41 | 5.6 | 1.1 | 22.1 |
| Example 4-12 | Colored Particle 41 | 5.6 | 1.1 | 22.1 |
| Comparative Example 4-1 | Colored Particle 41 | 5.6 | 1.1 | 22.1 |
| Comparative Example 4-2 | Colored Particle 41 | 5.6 | 1.1 | 22.1 |
| Comparative Example 4-3 | Cornparative Colored Particle 41 | 5.9 | 1.1 | 3.20 |
| Comparative Example 4-4 | Colored Particle 41 | 5.6 | 1.1 | 22.1 |

TABLE 20

| | External Additive A | Density of External Additive (g/cm$^3$) | Particle Size (μm) | Addition Amount (wt %) | Coverage (%) | External Additive B | Density of External Additive (g/cm$^3$) | Particle Diameter (μm) | Addition Amount (wt %) | Coverage (%) | Total coverage (%) |
|---|---|---|---|---|---|---|---|---|---|---|---|
| Example 4-1 | Hydrophobic Particle 41 | 2.2 | 0.006 | 2 | 22.57 | Hydrophobic Particle 45 | 4.2 | 0.125 | 4 | 5.03 | 27.6 |
| Example 4-2 | Hydrophobic Particle 41 | 2.2 | 0.006 | 2 | 24.28 | Hydrophobic Particle 45 | 4.2 | 0.125 | 4 | 5.12 | 29.4 |
| Example 4-3 | Hydrophobic Particle 41 | 2.2 | 0.006 | 2 | 20.48 | Hydrophobic Particle 45 | 4.2 | 0.125 | 4 | 4.93 | 25.41 |
| Example 4-4 | Hydrophobic Particle 41 | 2.2 | 0.006 | 2 | 17.84 | Hydrophobic Particle 45 | 4.2 | 0.125 | 4 | 4.8 | 22.64 |
| Example 4-5 | Hydrophobic Particle 41 | 2.2 | 0.006 | 2 | 31.14 | Hydrophobic Particle 44 | 4.2 | 0.068 | 3 | 5.02 | 36.16 |
| Example 4-6 | Hydrophobic Particle 42 | 2.2 | 0.018 | 2 | 10.02 | Hydrophobic Particle 44 | 4.2 | 0.068 | 3 | 4.67 | 14.69 |
| Example 4-7 | Hydrophobic Particle 43 | 4.0 | 0.026 | 2 | 3.66 | Hydrophobic Particle 44 | 4.2 | 0.068 | 3 | 3.91 | 7.57 |
| Example 4-8 | Hydrophobic Particle 41 | 2.2 | 0.006 | 2 | 17.62 | Hydrophobic Particle 46 | 1.1 | 0.250 | 4 | 5.5 | 23.12 |
| Example 4-9 | Hydrophobic Particle 41 | 2.2 | 0.006 | 2 | 17.62 | Hydrophobic Particle 47 | 3.3 | 0.890 | 4 | 4.14 | 21.76 |
| Example 4-10 | Hydrophobic Particle 41 | 2.2 | 0.006 | 2 | 17.62 | Hydrophobic Particle 48 | 7.0 | 1.200 | 4 | 4.05 | 21.67 |
| Example 4-11 | Hydrophobic Particle 41 | 2.2 | 0.006 | 0.03 | 13.39 | Hydrophobic Particle 45 | 4.2 | 0.125 | 0.3 | 0.38 | 3.77 |
| Example 4-12 | Hydrophobic Particle 41 | 2.2 | 0.006 | 8 | 90.27 | Hydrophobic Particle 45 | 4.2 | 0.125 | 5 | 6.29 | 96.56 |
| Comparative Example 4-1 | Hydrophobic Particle 41 | 2.2 | 0.006 | 2 | 22.57 | — | — | — | — | — | 22.57 |
| Comparative Example 4-2 | — | — | — | — | — | Hydrophobic Particle 44 | 4.2 | 0.060 | 6 | 9.23 | 9.23 |
| Comparative Example 4-3 | Hydrophobic Particle 41 | 2.2 | 0.006 | 0.05 | 36.01 | Hydrophobic Particle 44 | 4.2 | 0.060 | 0.8 | 3.78 | 39.79 |
| Comparative Example 4-4 | Hydrophobic Particle 41 | 2.2 | 0.006 | 1 | 11.28 | Hydrophobic Particle 41 | 1.1 | 2.200 | 1 | 1.06 | 12.34 |

Developers were prepared by mixing the above-mentioned toner with a carrier (volume average particle size of 45 μm) covered by a styrene-acryl resin so that the concentration of the toner was 5.9 weight percent.

The evaluation was performed by using the Konica DC-7728 manufactured by Konica Corp. and a non-contact developing method. Furthermore, as a photoreceptor, a lamination-type organic photoreceptor was used and the development was performed by the reversal development. Moreover, the blade cleaning method was utilized as a cleaning method.

At low temperature and low humidity (10° C., 20 percent Relative humidity), 50,000 copies were continuously produced under a image occupying ratio of 6 percent. At every 1,000 copy, image defects such as white spot, passing-through, etc. were evaluated. Table 21 below shows the number of the copy on which any defect appeared. Furthermore, a white spot has a diameter of 0.3 mm or more. In addition, at low temperature and low humidity, initial developability and resolution were evaluated. The initial developability is expressed by the weight (mg) of a developed toner per unit area (cm$^2$) wherein the developed toner is defined as toner developed on the photoreceptor. The resolution was evaluated in such a manner that a oblique line cut when printed by a main 600 dpi scanning line was evaluated by visual observation.

Furthermore, the cleaning conditions were such that the structure was as shown in FIG. 5 and the holder was arranged at an angle $\theta_1$ of 22° to the photoreceptor, and as a material composing a cleaning blade itself, urethane rubber was employed. The rubber hardness was 65° and the thickness was 2 mm and the exterior length of the holder was 8 mm. Furthermore, the contact enforcing force onto the photoreceptor was set at 15 gf/cm.

Furthermore, the size of paper employed for the evaluation was A4.

TABLE 21

| | Image Defect | Developability (mg/cm$^2$) | Presence of Oblique Line Cut |
|---|---|---|---|
| Example 4-1 | None | 1.01 | None |
| Example 4-2 | None | 1.01 | None |
| Example 4-3 | None | 1.01 | None |
| Example 4-4 | None | 1.01 | None |
| Example 4-5 | None | 1.01 | None |
| Example 4-6 | None | 1.01 | None |
| Example 4-7 | None | 1.01 | None |
| Example 4-8 | None | 1.02 | None |
| Example 4-9 | None | 1.02 | None |
| Example 4-10 | None | 1.01 | None |
| Example 4-11 | None | 0.98 | None |
| Example 4-12 | None | 0.97 | None |
| Comparative Example 4-1 | 25Kp White Spot | 0.54 | Present partly |
| Comparative Example 4-2 | 15Kp White Spot | 0.72 | Present partly |
| Comparative Example 4-3 | 15Kp White Spot | 0.66 | None |
| Comparative Example 4-4 | 25Kp White Spot | 0.62 | None |

Kp means 1,000 copies.

As shown in Table 21, it is found that Developers 4-1 to 4-12 of the present invention are excellent in all evaluation items of image defect, developability and presence of oblique line cut as compared to Comparative Examples 4-1 to 4-4.

What is claimed is:

1. A toner for developing an electrostatic latent image-comprising colored particles, containing a colorant and a binder resin having a polar group, and hydrophobic particles, wherein said colored particles have a BET specific surface area of not less than 5 $m^2/g$ and said hydrophobic particles satisfy the following relation:

$$|pH_A - pH_B| \leqq 1.0$$

wherein said $pH_A$ is a pH value of said hydrophobic particles before storing and said $pH_B$ is a pH value of said hydrophobic particles after storing at 50° C. and 50% Relative humidity for 24 hours.

2. The toner of claim 1 wherein said hydrophobic particles are present in an amount of 0.1 to 5% by weight, based on said colored particles.

3. The toner of claim 2 wherein each said polar group is on a surface of one of said colored particles.

4. A developer for developing an electrostatic latent image comprising the toner of claim 1 and a carrier.

5. A developer for developing an electrostatic latent image comprising the toner of claim 2 and a carrier.

6. The toner of claim 1, wherein said hydrophobic particles have a number average primary particle size of 5 to 2000 nm.

7. The toner of claim 6, wherein said hydrophobic particles have a number average primary particle size of 5 to 100 nm.

8. The toner of claim 6, wherein said hydrophobic particles comprise first hydrophobic particles having a number average primary particle size of 5 to 100 nm and second hydrophobic particles having a number average primary particle size of 10 to 2000 nm.

9. The toner of claim 6, wherein said hydrophobic particles comprise first hydrophobic particles having a number average primary particle size of 5 to 100 nm and a BET specific surface area of 80 to 400 $m^2/g$ and second hydrophobic particles having a number average primary particle size of 60 to 150 nm and have a BET specific surface area of 30 to 60 $m^2/g$.

10. The toner of claim 6, wherein said hydrophobic particles comprise first hydrophobic particles having a number average primary particle size of 5 to 50 nm and second hydrophobic particles having a number average primary particle size of 60 to 2000 nm.

11. The toner of claim 1, wherein said hydrophobic particles comprise inorganic hydrophobic particles having a number average primary particle size of 5 to 150 nm.

12. The toner of claim 1, wherein said hydrophobic particles comprise organic hydrophobic particles having a number average primary particle size of 10 to 2000 nm.

13. The toner of claim 1, wherein said hydrophobic particles comprise organic hydrophobic particles having a number average primary particle size of 100 to 1500 nm.

14. The toner of claim 1, wherein said hydrophobic particles have a pH of 4 through 12.

15. The toner of claim 1, wherein said hydrophobic particles have a water content of not more than 1.0 percent by weight.

16. The toner of claim 1, wherein said polar group is selected from a group consisting of a carboxyl group, a sulfonic acid group and a phosphoric acid group.

* * * * *